US009695550B2

(12) United States Patent
Lindsey et al.

(10) Patent No.: US 9,695,550 B2
(45) **Date of Patent: *Jul. 4, 2017**

(54) PROCESS TO IMPROVE THE CONVERTABILITY OF PARENT ROLLS

(71) Applicant: The Procter & Gamble Company, Cincinnati, OH (US)

(72) Inventors: Bryan J. Lindsey, Albany, GA (US); David Alan Ross, Sharonville, OH (US); Brent William Broehm, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/185,423

(22) Filed: Jun. 17, 2016

(65) Prior Publication Data

US 2016/0298296 A1 Oct. 13, 2016

Related U.S. Application Data

(63) Continuation of application No. 15/070,557, filed on Mar. 15, 2016, which is a continuation of application No. 14/528,254, filed on Oct. 30, 2014, now Pat. No. 9,284,686.

(51) Int. Cl.

| | |
|---|---|
| ***D21G 9/00*** | (2006.01) |
| ***D21F 11/14*** | (2006.01) |
| ***D21H 27/00*** | (2006.01) |

(52) U.S. Cl.

CPC ..... *D21G 9/0054* (2013.01); *D21F 11/14* (2013.01); *D21F 11/145* (2013.01); *D21G 9/0009* (2013.01); *D21H 27/004* (2013.01)

(58) Field of Classification Search

CPC ..... D21F 11/14; D21F 11/1457; D21F 7/06; D21G 9/0045; D21G 9/0054; D21G 9/00; D21G 9/0009; D21G 1/00; D21G 9/036; B65H 18/26; B65H 2220/01; B65H 18/14; B65H 18/28; B65H 2557/24; B65H 2557/64; B65H 2801/84; B65H 43/00; G01B 11/06; G01N 2021/8663; Y10T 428/1303; D21H 27/00; D21H 27/004

See application file for complete search history.

(56) References Cited

U.S. PATENT DOCUMENTS

| | | | | |
|---|---|---|---|---|
| 5,580,423 | A | 12/1996 | Ampulski et al. | |
| 5,649,448 | A | 7/1997 | Koskimies et al. | |
| 5,845,868 | A | 12/1998 | Klerelid et al. | |
| 5,944,273 | A | 8/1999 | Lin et al. | |
| 6,698,681 | B1 | 3/2004 | Guy et al. | |
| 6,755,940 | B2 | 6/2004 | Lin et al. | |
| 7,344,105 | B2 | 3/2008 | Lindsey | |
| 7,398,943 | B2 | 7/2008 | Horneck et al. | |
| 7,780,817 | B2 | 8/2010 | Hellstrom | |
| 7,799,171 | B2 | 9/2010 | Mäenpää et al. | |
| 8,260,592 | B2 | 9/2012 | Schmitt et al. | |
| 8,277,609 | B2 | 10/2012 | Hermans et al. | |
| 8,560,275 | B2 | 10/2013 | Mustonen et al. | |
| 9,284,686 | B1 * | 3/2016 | Lindsey | D21H 27/004 |
| 9,518,362 | B2 * | 12/2016 | Bomstad | D21F 11/14 |
| 9,546,449 | B2 * | 1/2017 | Lindsey | D21H 27/004 |
| 2001/0020523 | A1 | 9/2001 | Begemann et al. | |
| 2006/0289692 | A1 | 12/2006 | Horneck et al. | |
| 2009/0056894 | A1 | 3/2009 | Hermans et al. | |
| 2009/0189008 | A1 | 7/2009 | Gustavsson | |
| 2013/0083332 | A1 | 4/2013 | Heath et al. | |
| 2013/0329037 | A1 | 12/2013 | Shakespeare et al. | |
| 2014/0231574 | A1 | 8/2014 | Binner, Sr. | |
| 2015/0292155 | A1 | 10/2015 | Bomstad et al. | |
| 2015/0292156 | A1 | 10/2015 | Bomstad et al. | |
| 2015/0292161 | A1 | 10/2015 | Bomstad et al. | |
| 2015/0292162 | A1 * | 10/2015 | Bomstad | D21F 11/14 700/125 |
| 2015/0292163 | A1 * | 10/2015 | Bomstad | D21F 11/14 700/125 |
| 2016/0194827 | A1 * | 7/2016 | Lindsey | D21H 27/004 162/118 |
| 2016/0298296 | A1 * | 10/2016 | Lindsey | D21H 27/004 |
| 2016/0362839 | A1 * | 12/2016 | Bomstad | D21F 11/14 |

FOREIGN PATENT DOCUMENTS

| | | | |
|---|---|---|---|
| DE | 102007033394 | A1 | 1/2009 |
| EP | 2644772 | A1 | 10/2013 |
| WO | WO-2013/007864 | A1 | 1/2013 |
| WO | WO-2013/037931 | A1 | 3/2013 |
| WO | WO-2013/103831 | A1 | 7/2013 |

OTHER PUBLICATIONS

PCT International Search Report, mailed Feb. 23, 2016, 100 pages.

* cited by examiner

*Primary Examiner* — Jose Fortuna

(74) *Attorney, Agent, or Firm* — Peter D. Meyer

(57) ABSTRACT

The present disclosure is directed toward a process for adjusting a papermaking process for producing parent rolls of convolutely wound web material having a machine direction (MD) and a cross-machine direction (CD) coplanar and orthogonal thereto that improves the characteristics of the parent rolls of wound web material to improve downstream convertability.

19 Claims, 17 Drawing Sheets

PROCESS TO IMPROVE THE CONVERTABILITY OF PARENT ROLLS

FIELD OF THE INVENTION

The present invention is related to continuous papermaking machines. More particularly, the present invention relates to processes that improve the quality of the parent rolls of web materials that are suitable for making paper products.

BACKGROUND OF THE INVENTION

Disposable products such as facial tissue, sanitary tissue, paper towels, and the like are typically made from one or more webs of paper. If the products are to perform their intended tasks, the paper webs from which they are formed must exhibit certain physical characteristics. Among the more important of these characteristics are strength, softness, and absorbency. Strength is the ability of a paper web to retain its physical integrity during use. Softness is the pleasing tactile sensation the user perceives as the user crumples the paper in his or her hand and contacts various portions of his or her anatomy with the paper web. Softness generally increases as the paper web stiffness decreases. Absorbency is the characteristic of the paper web which allows it to take up and retain fluids. Typically, the softness and/or absorbency of a paper web are increased at the expense of the strength of the paper web. Accordingly, papermaking methods have been developed in an attempt to provide soft and absorbent paper webs having desirable strength characteristics.

Processes for the manufacture of paper products can generally involve the preparation of aqueous slurry of cellulosic fibers and subsequent removal of water from the slurry while contemporaneously rearranging the fibers to form an embryonic web. Various types of machinery can be employed to assist in the dewatering process. A typical manufacturing process employs the aforementioned Fourdrinier wire papermaking machine where paper slurry is fed onto a surface of a traveling endless wire where the initial dewatering occurs. In a conventional wet press process, the fibers are transferred directly to a capillary de-watering belt where additional de-watering occurs. In a structured web process, the fibrous web is subsequently transferred to a papermaking belt where rearrangement of the fibers is carried out. Alternatively, air-laid processes for the formation of such structures are also possible.

After the initial formation of the web, which later becomes the cellulosic fibrous structure, the papermaking machine transports the web to the dry end of the machine. In the dry end of a conventional machine, a press felt compacts the web into a single region of cellulosic fibrous structure having uniform density and basis weight prior to final drying. The final drying can be accomplished by a heated drum, such as a Yankee drying drum, or by a conventional de-watering press. Through air drying can yield significant improvements in consumer products. In a through-air-drying process, the formed web is transferred to an air pervious through-air-drying belt. This "wet transfer" typically occurs at a pick-up shoe, at which point the web may be first molded to the topography of the through air drying belt. In other words, during the drying process, the embryonic web takes on a specific pattern or shape caused by the arrangement and deflection of cellulosic fibers. A through air drying process can yield a structured paper having regions of different densities. This type of paper has been used in commercially successful products, such as Bounty® paper towels and Charming bath tissue. Traditional conventional felt drying does not produce a structured paper having these advantages. However, it would be desirable to produce a structured paper using conventional drying at speeds equivalent to, or greater than, a through air dried process.

Once the drying phase of the papermaking process is finished, the arrangement and deflection of fibers is complete. However, depending on the type of the finished product, paper may go through additional processes such as calendering, softener application, and converting. These processes tend to compact the dome regions of the paper and reduce the overall thickness. Thus, producing high caliper finished paper products having two physically distinct regions requires forming cellulosic fibrous structures in the domes having a resistance to mechanical pressure.

It would be advantageous to provide a wet pressed paper web having increased strength and wicking ability for a given level of sheet flexibility. It would be also be advantageous to provide a non-embossed patterned paper web having a relatively high density continuous network, a plurality of relatively low density domes dispersed throughout the continuous network, and a reduced thickness transition region at least partially encircling each of the low density domes.

SUMMARY OF THE INVENTION

An embodiment of the present disclosure provides for a process for adjusting a papermaking process for producing parent rolls of convolutely wound web material having a machine direction (MD) and a cross-machine direction (CD) coplanar and orthogonal thereto that improves the characteristics of the parent rolls of wound web material to improve downstream convertability. The process for adjusting the papermaking process comprising the steps of: a) providing a first parent roll comprising a first web material to a parent roll converting operation, the first parent roll being produced by the papermaking process; b) measuring a first physical property of the first web material in the MD and CD during the converting of the first parent roll by the parent roll converting operation; c) measuring a second physical property of the first web material in the MD and CD during the converting of the first parent roll by the parent roll converting operation; d) placing the measured first and second physical properties of the first web material into a data table; e) manipulating the measured first and second physical properties of the first web material in the MD from the data table over time; f) manipulating the measured first and second physical properties of the first web material in the CD from the data table over time; g) generating a relationship equation for each of the measured first and second physical properties of the first parent roll correlating each of the first and second physical properties of the first web material; h) providing a second parent roll comprising a second web material to the parent roll converting operation, the first parent roll being produced by the papermaking process; i) measuring the first physical property of the second web material in the MD and CD during the converting of the second parent roll by the parent roll converting operation; j) measuring the second physical property of the second web material in the MD and CD during the converting of the second parent roll by the parent roll converting operation; k) comparing each of the first physical property of the second web material and the second physical property of the second web material to the relationship equation generated in step (g); l) generating a correction for the relationship equation generated in step (g) that correlates each of the first and second physical properties of the second web material; m) using the corrected relationship equation generated in step (l) to create a control algorithm that minimizes variability of either of the first and second physical properties of a third web material, the third web material to be formed into a third parent roll; n) adjusting the papermaking process for producing the third parent roll by applying the control algorithm generated in step (m) to a centerline related to the papermaking process; o) producing the third web material according to the adjusted papermaking process; and, p) winding the third web material produced by the papermaking process of step (o) into the third parent roll.

Another embodiment of the present disclosure provides for a process for adjusting a papermaking process for producing parent rolls of convolutely wound web material having a machine direction (MD) and a cross-machine direction (CD) coplanar and orthogonal thereto that improves the characteristics of the parent rolls of wound web material to improve downstream convertability. The process for adjusting the papermaking process comprising the steps of: a) conveying a first web material produced by the papermaking process to a measurement station; b) measuring or inferring a first property of the first web material in the MD and CD prior to forming a first parent roll; c) measuring or inferring a second property of the first web material in the MD and CD prior to forming the first parent roll; d) conveying the first web material to a winding process, the winding process convolutely winding the first web material to form the first parent roll; e) placing the first and second measured or inferred properties of the first web material into a data table; f) manipulating the measured or inferred data for each of the first and second properties of the first web material in the MD from the data table over time; g) manipulating the measured or inferred data for each of the first and second properties of the first web material in the CD from the data table over time; h) generating a relationship equation for each of the measured or inferred first and second properties of the first web material; i) providing the first parent roll to a parent roll converting operation; j) measuring the first physical property of the first web material in the MD and CD during the parent roll converting operation; k) measuring the second physical property of the first web material in the MD and CD during the parent roll converting operation; l) comparing each of the measured first and second physical properties of the first web material during the parent roll converting operation to the relationship equation generated in step (h); m) generating a correction for the relationship equation generated in step (h) that correlates each of the measured first and second physical properties of the first web material during the parent roll converting operation; n) using the corrected relationship equation generated in step (m) to create a control algorithm that minimizes variability of either of the first and second physical properties of the first web material; o) adjusting the papermaking process by applying the control algorithm generated in step (n) to a centerline related to the papermaking process; p) producing a second web material according to the adjusted papermaking process; and, q) winding the second web material produced by the papermaking process of step (p) into a second parent roll.

DETAILED DESCRIPTION OF THE INVENTION

As used herein, "machine direction" is defined as the usual direction of travel of a web material through any processing equipment. "Cross-machine direction" is defined as the direction orthogonal and co-planar to the usual direction of travel of a web material through any processing equipment. "Z-direction" is defined as the direction orthogonal to both the machine and cross-machine directions.

Figure 1:
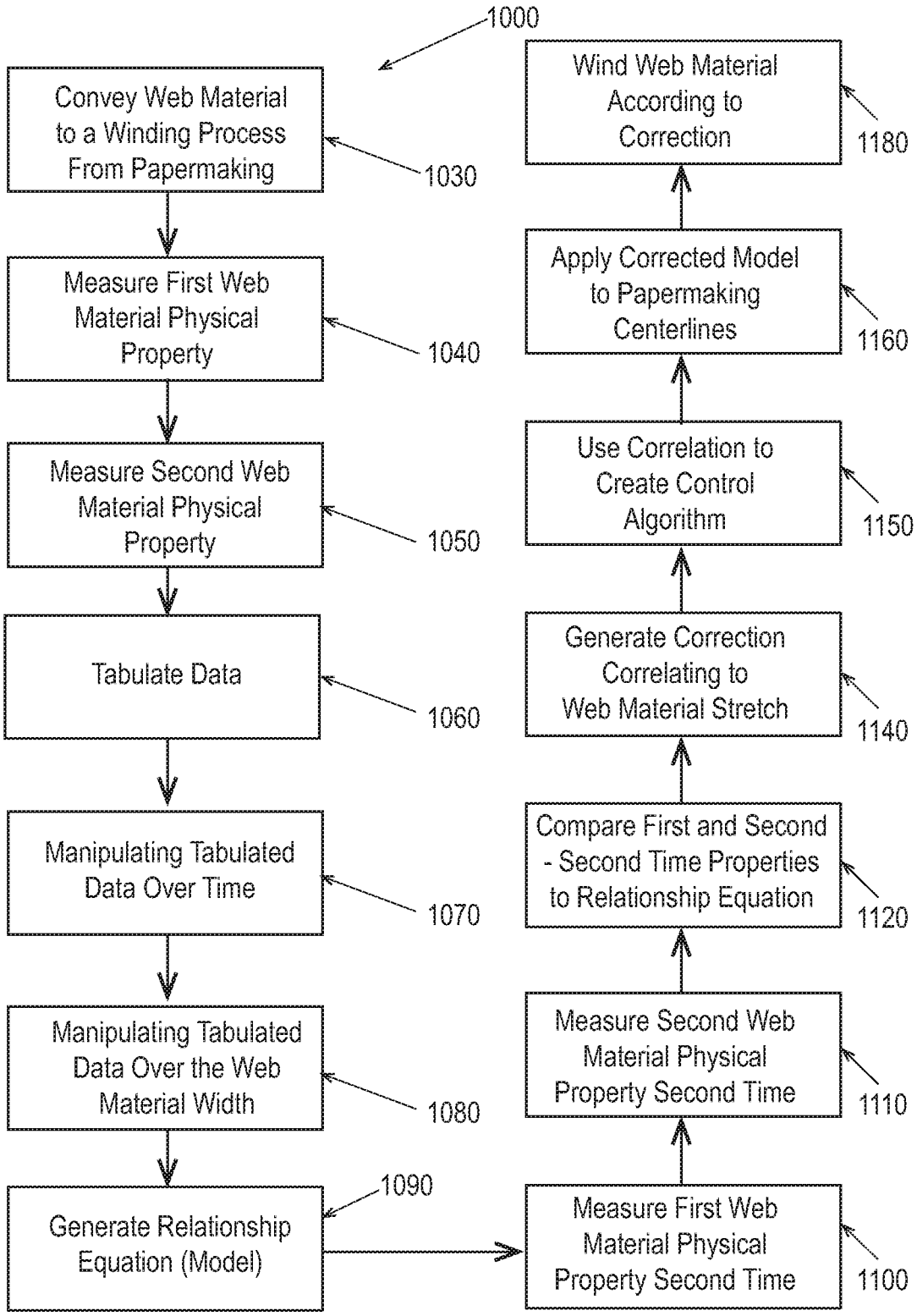
FIG. 1 is a flow chart of one embodiment of process for improving certain characteristics of parent rolls and adjusting the papermaking process that produces those parent rolls to provide parent rolls that improve downstream convertability.

FIG. 1 illustrates an exemplary embodiment of a process 1000 for improving certain characteristics of parent rolls and adjusting the papermaking process that produces those parent rolls to provide parent rolls that improve downstream convertability. It is believed that providing an improved papermaking process that produces parent rolls that have the desired physical characteristics suitable for a particular downstream converting process can provide the downstream converting operations with a better quality material that experiences less break-outs as well as other issues that can occur in downstream converting. The steps that can be included in the process 1000 are discussed infra.

Figure 2:
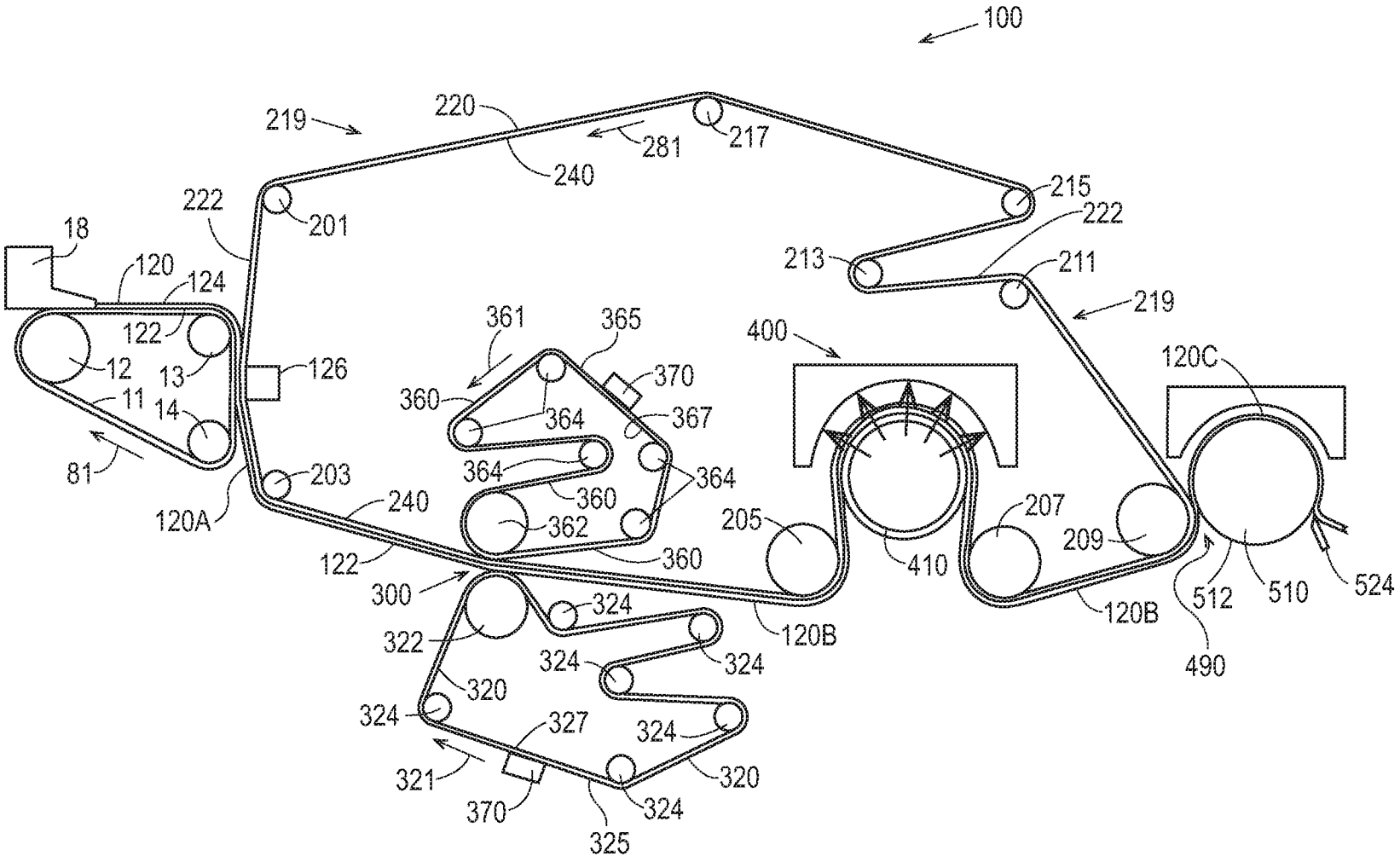
FIG. 2 is a schematic diagram of an exemplary papermaking process suitable for use with the process for improving certain characteristics of parent rolls and adjusting the papermaking process that produces those parent rolls to provide parent rolls that improve downstream convertability.

FIG. 2 provides an exemplary embodiment of a continuous papermaking machine 100 which can be used in practicing the process 1000 of the present invention. The process of the present invention comprises a number of steps or operations which occur in sequence. While the process of the present invention is preferably carried out in a continuous fashion, it will be understood that the present invention can comprise a batch operation, such as a handsheet making process. A preferred sequence of steps will be described, with the understanding that the scope of the present invention is determined with reference to the appended claims.

According to one embodiment of the present invention, an embryonic web 120 of papermaking fibers having certain measureable physical properties such as basis weight, topography, caliper, tension, fiber orientation, moisture content, MD and/or CD tensile strength, and/or MD and/or CD web stretch, combinations thereof, and the like, is formed from an aqueous dispersion of papermaking fibers on a foraminous forming member 11. The embryonic web 120 is then transferred to a foraminous imprinting member 219 having a first web contacting face 220 comprising a web imprinting surface and a deflection conduit portion. If desired, a portion of the papermaking fibers in the embryonic web 120 can be deflected into deflection conduit portion of the foraminous imprinting member 219 without densifying the web, thereby forming an intermediate web 120A.

The intermediate web 120A is carried on the foraminous imprinting member 219 from the foraminous forming member 11 to a compression nip 300 formed by opposed compression surfaces on first and second nip rolls 322 and 362. A first dewatering felt 320 is positioned adjacent the intermediate web 120A, and a second dewatering felt 360 is positioned adjacent the foraminous imprinting member 219. The intermediate web 120A and the foraminous imprinting member 219 are then pressed between the first and second dewatering felts 320 and 360 in the compression nip 300 to further deflect a portion of the papermaking fibers into the deflection conduit portion of the imprinting member 219; to densify, a portion of the intermediate web 120A associated with the web imprinting surface; and to further dewater the web by removing water from both sides of the web, thereby forming a molded web 120B which is relatively dryer than the intermediate web 120A.

The molded web 120B is carried from the compression nip 300 on the foraminous imprinting member 219. The molded web 120B can be pre-dried in a through air dryer 400 by directing heated air to pass first through the molded web, and then through the foraminous imprinting member 219, thereby further drying the molded web 120B. The web imprinting surface of the foraminous imprinting member 219 can then be impressed into the molded web 120B such as at a nip formed between a roll 209 and a dryer drum 510, thereby forming an imprinted web 120C. Impressing the web imprinting surface into the molded web can further densify the portions of the web associated with the web imprinting surface. The imprinted web 120C can then be dried on the dryer drum 510 and creped from the dryer drum by a doctor blade 524.

Examining the process steps according to the present invention in more detail, a first step in practicing the present invention is providing an aqueous dispersion of papermaking fibers derived from wood pulp to form the embryonic web 120. The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene, polyester, and polypropylene fibers, may also be utilized in combination with natural cellulosic fibers. One exemplary polyethylene fiber which may be utilized is Pulpex™, available from Hercules, Inc. (Wilmington, Del.). Applicable wood pulps include chemical pulps, such as Kraft, sulfite, and sulfate pulps, as well as mechanical pulps including, for example, groundwood, thermomechanical pulp and chemically modified thermomechanical pulp. Pulps derived from both deciduous trees (hereinafter, also referred to as "hardwood") and coniferous trees (hereinafter, also referred to as "softwood") may be utilized. Also applicable to the present invention are fibers derived from recycled paper, which may contain any or all of the above categories as well as other non-fibrous materials such as fillers and adhesives used to facilitate the original papermaking.

In addition to papermaking fibers, the papermaking furnish used to make paper product structures may have other components or materials added thereto as may be or later become known in the art. The types of additives desirable will be dependent upon the particular end use of the paper product sheet contemplated. For example, in products such as toilet paper, paper towels, facial tissues and other similar products, high wet strength is a desirable attribute. Thus, it is often desirable to add to the papermaking furnish chemical substances known in the art as "wet strength" resins. It is to be understood that the addition of chemical compounds such as the wet strength and temporary wet strength resins discussed above to the pulp furnish is optional and is not necessary for the practice of the present development.

The embryonic web 120 is preferably prepared from an aqueous dispersion of the papermaking fibers, though dispersions of the fibers in liquids other than water can be used. The fibers are dispersed in water to form an aqueous dispersion having a consistency of from about 0.1 to about 0.3 percent. The percent consistency of a dispersion, slurry, web, or other system is defined as 100 times the quotient obtained when the weight of dry fiber in the system under discussion is divided by the total weight of the system. Fiber weight is always expressed on the basis of bone dry fibers.

Referring again to FIG. 2, a second step in the practice of the present invention is forming the embryonic web 120 of papermaking fibers. An aqueous dispersion of papermaking fibers is provided to a headbox 18 which can be of any convenient design. From the headbox 18 the aqueous dispersion of papermaking fibers is delivered to a foraminous forming member 11 to form an embryonic web 120. The forming member 11 can comprise a continuous Fourdrinier wire. Alternatively, the foraminous forming member 11 can comprise a plurality of polymeric protuberances joined to a continuous reinforcing structure to provide an embryonic web 120 having two or more distinct basis weight regions, such as is disclosed in U.S. Pat. No. 5,245,025. While a single forming member 11 is shown in FIG. 2, single or double wire forming apparatus may be used. Other forming wire configurations, such as S or C wrap configurations can be used.

The forming member 11 is supported by a breast roll 12 and plurality of return rolls, of which only two return rolls 13 and 14 are shown in FIG. 2. The forming member 11 is driven in the direction indicated by the arrow 81 by a drive means (not shown). The embryonic web 120 is formed from the aqueous dispersion of papermaking fibers by depositing the dispersion onto the foraminous forming member 11 and removing a portion of the aqueous dispersing medium. The embryonic web 120 has a first web face 122 contacting the foraminous member 11 and a second oppositely facing web face 124.

The embryonic web 120 can be formed in a continuous papermaking process, as shown in FIG. 2, or alternatively, a batch process, such as a handsheet making process can be used. In any regard, after the aqueous dispersion of papermaking fibers is deposited onto the foraminous forming member 11, an embryonic web 120 is formed by removal of a portion of the aqueous dispersing medium by techniques well known to those skilled in the art. Vacuum boxes, forming boards, hydrofoils, and the like are useful in effecting water removal from the aqueous dispersion on the foraminous forming member 11. The embryonic web 120 travels with the forming member 11 about the return roll 13 and brought into the proximity of a foraminous imprinting member 219 described in detail infra.

A third step in the practice of the present invention comprises transferring the embryonic web 120 from the foraminous forming member 11 to the foraminous imprinting member 219, to position the second web face 124 on the first web contacting face 220 of the foraminous imprinting member 219. Although the preferred embodiment of the foraminous imprinting member 219 of the present invention is in the form of an endless belt, it can be incorporated into numerous other forms which include, for instance, stationary plates for use in making hand sheets or rotating drums for use with other types of continuous process. Regardless of the physical form which the foraminous imprinting member 219 takes for the execution of the claimed invention, it is generally provided with the physical characteristics detailed infra.

A fourth step in the practice of the present invention comprises deflecting a portion of the papermaking fibers in the embryonic web 120 into the deflection conduit portion 230 of web contacting face 220 of the foraminous imprinting member 219, and removing water from the embryonic web 120 through the deflection conduit portion of the foraminous imprinting member 219 to form an intermediate web 120A of the papermaking fibers. The embryonic web 120 preferably has a consistency of between about 10 and about 25 percent at the point of transfer to facilitate deflection of the papermaking fibers into the deflection conduit portion 230 of the foraminous imprinting member 219.

The steps of transferring the embryonic web 120 to the imprinting member 219 and deflecting a portion of the papermaking fibers in the web 120 into the deflection conduit portion (not shown) of the foraminous imprinting member 219 can be provided, at least in part, by applying a differential fluid pressure to the embryonic web 120. For instance, the embryonic web 120 can be vacuum transferred from the forming member 11 to the imprinting member 219, such as by a vacuum box 126 shown in FIG. 1, or alternatively, by a rotary pickup vacuum roll (not shown). The pressure differential across the embryonic web 120 provided by the vacuum source (e.g. the vacuum box 126) deflects the fibers into the deflection conduit portion (not shown), and preferably removes water from the web through the deflection conduit portion (not shown) to raise the consistency of the web to between about 18 and about 30 percent. The pressure differential across the embryonic web 120 can range from between about 13.5 kPa and about 40.6 kPa (between about 4 to about 12 inHg). The vacuum provided by the vacuum box 126 permits transfer of the embryonic web 120 to the foraminous imprinting member 219 and deflection of the fibers into the deflection conduit portion 230 without compacting the embryonic web 120. Additional vacuum boxes (not shown) can be included to further dewater the intermediate web 120A.

A fifth step in the practice of the present invention comprises pressing the wet intermediate web 120A in the compression nip 300 to form the molded web 120B. Referring again to FIG. 2, the intermediate web 120A is carried on the foraminous imprinting member 219 from the foraminous forming member 11 and through the compression nip 300 formed between opposed compression surfaces on nip rolls 322 and 362. The first dewatering felt 320 is shown supported in the compression nip by the nip roll 322 and driven in the direction 321 around a plurality of felt support rolls 324. Similarly, the second dewatering felt 360 is shown supported in the compression nip 300 by the nip roll 362 and driven in the direction 361 around a plurality of felt support rolls 364. A felt dewatering apparatus 370, such as an Uhle vacuum box can be associated with each of the dewatering felts 320 and 360 to remove water transferred to the dewatering felts from the intermediate web 120A.

The nip rolls 322 and 362 can have generally smooth opposed compression surfaces, or alternatively, the rolls 322 and 362 can be grooved. In an alternative embodiment (not shown) the nip rolls can comprise vacuum rolls having perforated surfaces for facilitating water removal from the intermediate web 120A. The rolls 322 and 362 can have rubber coated opposed compression surfaces, or alternatively, a rubber belt can be disposed intermediate each nip roll and its associated dewatering felt. The nip rolls 322 and 362 can comprise solid rolls having a smooth, bonehard rubber cover, or alternatively, one or both of the rolls 322 and 362 can comprise a grooved roll having a bonehard rubber cover.

The term "dewatering felt" as used herein refers to a member that is absorbent, compressible, and flexible so that it is deformable to follow the contour of the non-monoplanar intermediate web 120A on the imprinting member 219, and capable of receiving and containing water pressed from an intermediate web 120A. The dewatering felts 320 and 360 can be formed of natural materials, synthetic materials, or combinations thereof.

A preferred but non-limiting dewatering felt 320, 360 can have a thickness of between about 2 mm to about 5 mm, a basis weight of about 800 to about 2000 grams per square meter, an average density (basis weight divided by thickness) of between about 0.35 gram per cubic centimeter and about 0.45 gram per cubic centimeter, and an air permeability of between about 15 and about 110 cubic feet per minute per square foot, at a pressure differential across the dewatering felt thickness of 0.12 kPa (0.5 inch of water). The dewatering felt 320 preferably has first surface 325 having a relatively high density, relatively small pore size, and a second surface 327 having a relatively low density, relatively large pore size. Likewise, the dewatering felt 360 preferably has a first surface 365 having a relatively high density, relatively small pore size, and a second surface 367 having a relatively low density, relatively large pore size. The relatively high density and relatively small pore size of the first felt surfaces 325, 365 promote rapid acquisition of the water pressed from the web in the nip 300. The relatively low density and relatively large pore size of the second felt surfaces 327, 367 provide space within the dewatering felts for storing water pressed from the web in the nip 300. Suitable dewatering felts 320 and 360 are commercially available as SUPERFINE DURAMESH, style XY31620 from the Albany International Company of Albany, N.Y.

The intermediate web 120A and the web imprinting surface 222 are positioned intermediate the first and second felt layers 320 and 360 in the compression nip 300. The first felt layer 320 is positioned adjacent the first face 122 of the intermediate web 120A. The web imprinting surface 222 is positioned adjacent the second face 124 of the web 120A. The second felt layer 360 is positioned in the compression nip 300 such that the second felt layer 360 is in flow communication with the deflection conduit portion 230.

Referring again to FIG. 2, the first surface 325 of the first dewatering felt 320 is positioned adjacent the first face 122 of the intermediate web 120A as the first dewatering felt 320 is driven around the nip roll 322. Similarly, the first surface 365 of the second dewatering felt 360 is positioned adjacent the second felt contacting face 240 of the foraminous imprinting member 219 as the second dewatering felt 360 is driven around the nip roll 362. Accordingly, as the intermediate web 120A is carried through the compression nip 300 on the foraminous imprinting fabric 219, the intermediate web 120A, the imprinting fabric 219, and the first and second dewatering felts 320 and 360 are pressed together between the opposed surfaces of the nip rolls 322 and 362. Pressing the intermediate web 120A in the compression nip 300 further deflects the paper making fibers into the deflection conduit portion 230 of the imprinting member 219, and removes water from the intermediate web 120A to form the molded web 120B. The water removed from the web is received by and contained in the dewatering felts 320 and 360. Water is received by the dewatering felt 360 through the deflection conduit portion 230 of the imprinting member 219.

The molded web 120B is preferably pressed to have a consistency of at least about 30 percent at the exit of the compression nip 300. Pressing the intermediate web 120A as shown in FIG. 2 molds the web to provide a first relatively high density region associated with the web imprinting surface 222 and a second relatively low density region of the web associated with the deflection conduit portion 230. Pressing the intermediate web 120A on an imprinting fabric 219 having a macroscopically monoplanar, patterned, continuous network web imprinting surface 222, can be provided as a molded web 120B having a macroscopically monoplanar, patterned, continuous network regions having a relatively high density, and a plurality of discrete, relatively low density domes dispersed throughout the continuous, relatively high density network region.

A sixth step in the practice of the present invention can comprise pre-drying the molded web 120B, such as with a through-air dryer 400 as shown in FIG. 2. The molded web 120B can be pre-dried by directing a drying gas, such as heated air, through the molded web 120B. In one embodiment, the heated air is directed first through the molded web 120B from the first web face 122 to the second web face 124, and subsequently through the deflection conduit portion 230 of the imprinting member 219 on which the molded web is carried. The air directed through the molded web 120B partially dries the molded web 120B. In addition, without being limited by theory, it is believed that air passing through the portion of the web associated with the deflection conduit portion 230 can further deflect the web into the deflection conduit portion 230, and reduce the density of the relatively low density region, thereby increasing the bulk and apparent softness of the molded web 120B. In one embodiment the molded web 120B can have a consistency of between about 30 and about 65 percent upon entering the through air dryer 400, and a consistency of between about 40 and about 80 upon exiting the through air dryer 400.

Referring to FIG. 2, the through air dryer 400 can comprise a hollow rotating drum 410. The molded web 120B can be carried around the hollow drum 410 on the imprinting member 219, and heated air can be directed radially outward from the hollow drum 410 to pass through the web 120B and the imprinting member 219. Alternatively, the heated air can be directed radially inward (not shown). Suitable through air dryers for use in practicing the present invention are disclosed in U.S. Pat. Nos. 3,303,576 and 5,274,930. Alternatively, one or more through air dryers 400 or other suitable drying devices can be located upstream of the nip 300 to partially dry the web prior to pressing the web in the nip 300.

A seventh step in the practice of the present invention can comprise impressing the web imprinting surface 222 of the foraminous imprinting member 219 into the molded web 120B to form an imprinted web 120C. Impressing the web imprinting surface 222 into the molded web 120B serves to further densify, the relatively high density region of the molded web, thereby increasing the difference in density between the regions 1083 and 1084. Referring to FIG. 1, the molded web 120B is carried on the imprinting member 219 and interposed between the imprinting member 219 and an impression surface at a nip 490. The impression surface can comprise a surface 512 of a heated drying drum 510, and the nip 490 can be formed between a roll 209 and the dryer drum 510. The imprinted web 120C can then be adhered to the surface 512 of the dryer drum 510 with the aid of a creping adhesive, and finally dried. The dried, imprinted web 120C can be foreshortened as it is removed from the dryer drum 510, such as by creping the imprinted web 120C from the dryer drum with a doctor blade 524.

One of ordinary skill will recognize that the simultaneous imprinting, dewatering, and transfer operations may occur in embodiments other than those using dryer drum such as a Yankee drying drum. For example, two flat surfaces may be juxtaposed to form an elongate nip therebetween. Alternatively, two unheated rolls may be utilized. The rolls may be, for example, part of a calendar stack, or an operation which prints a functional additive onto the surface of the web. Functional additives may include: lotions, emollients, dimethicones, softeners, perfumes, menthols, combinations thereof, and the like.

The method provided by the present invention is particularly useful for making paper webs having a basis weight of between about 10 grams per square meter to about 65 grams per square meter. Such paper webs are suitable for use in the manufacture of single and multiple ply tissue and paper towel products.

Figure 3:
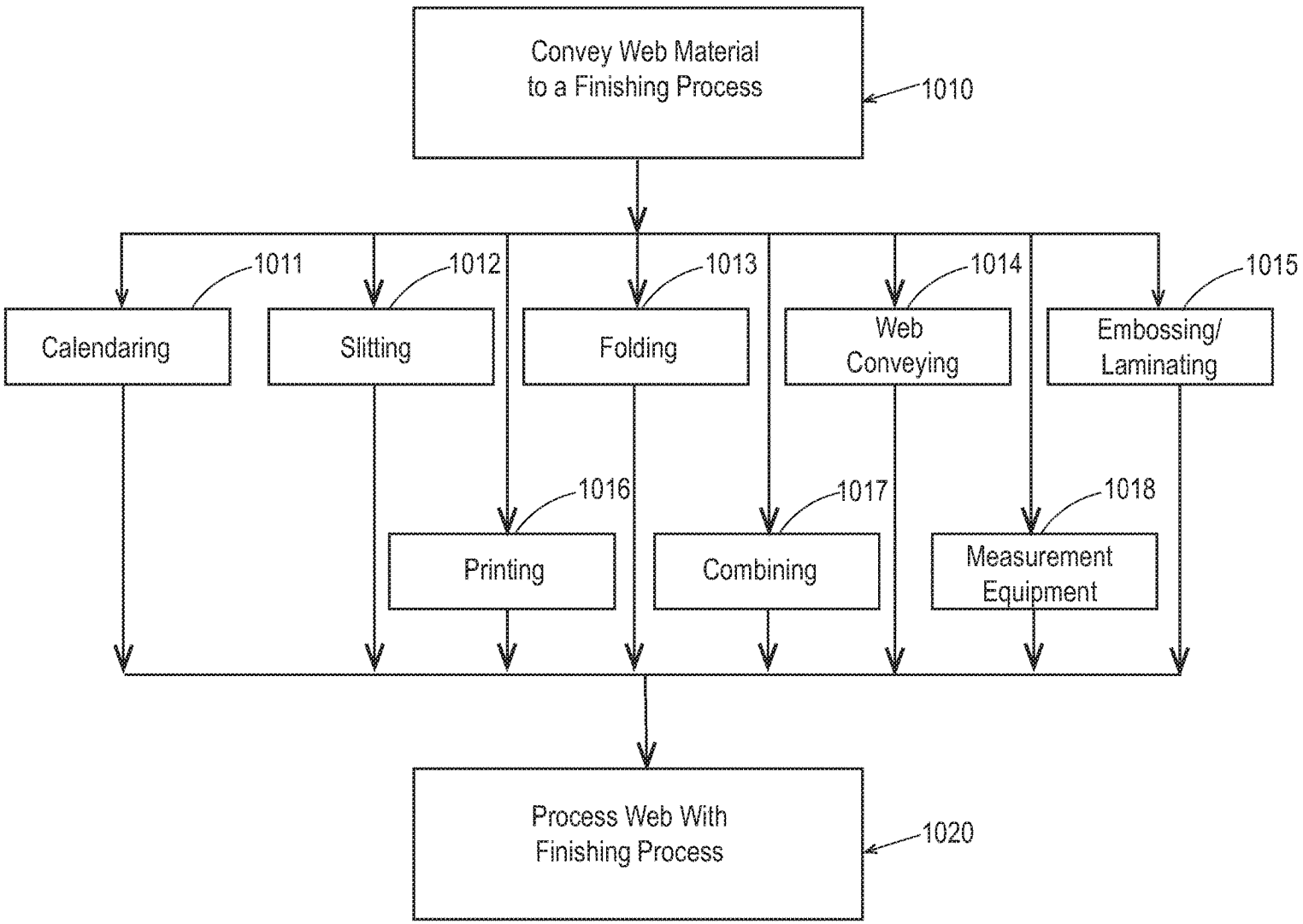
FIG. 3 is a flow chart of an exemplary process for conveying a web material to a finishing process consistent with the method described herein.

Turning to FIG. 3, the next step in the process 1000 for improving certain characteristics of parent rolls can optionally provide for the conveying of the manufactured web material to a finishing process 1010. The finishing process 1010 can be provided prior to the convolute winding of the web material about a core to form a parent roll. Exemplary finishing processes 1010 can include calendaring 1011, slitting 1012, folding 1013, web conveying (e.g., Mt. Hope, festooning, air foils, etc.) 1014, embossing and/or laminating 1015, printing 1016, combining 1017, as well providing the web material to known measurement equipment 1018 for the evaluation of web quality (e.g., Honeywell Mx).

Figure 4:
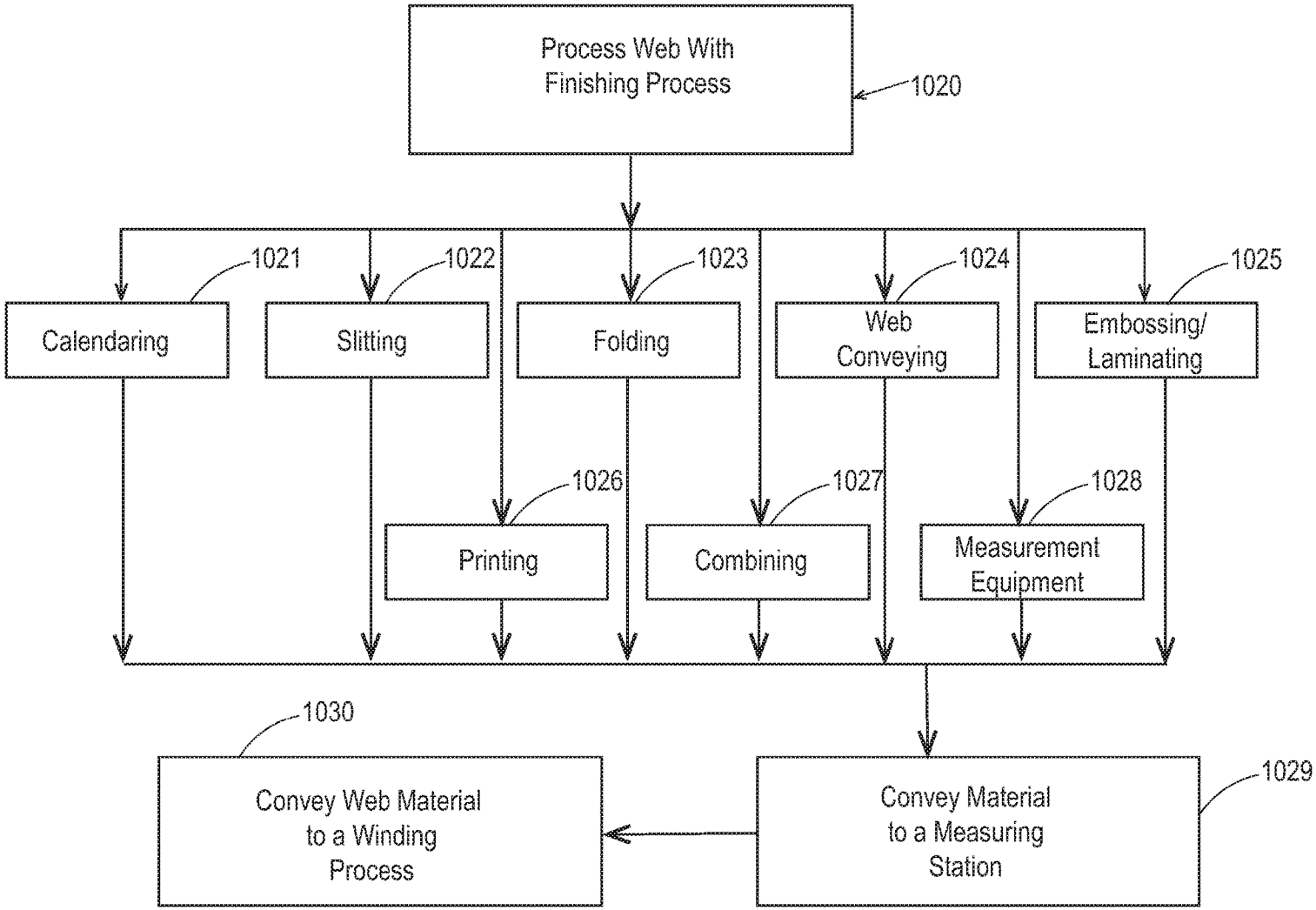
FIG. 4 is a flow chart of an exemplary process for processing a web material with a finishing process consistent with the method described herein.

Turning to FIG. 4, the next step in the process 1000 for improving certain characteristics of parent rolls can optionally provide for processing the manufactured web material by a finishing process 1020. The finishing process 1020 can be provided prior to the convolute winding of the web material about a core to form a parent roll. Exemplary finishing processes 1020 can include calendaring 1021, slitting 1022, folding 1023, web conveying (e.g., Mt. Hope, festooning, air foils, etc.) 1024, embossing and/or laminating 1025, printing 1026, combining 1027, as well providing the web material to known measurement equipment 1028 for the evaluation of web properties. The web material is then preferably conveyed to a measurement station 1029 for the measurement or inference of a first physical property prior to any subsequent conveyance to a winding process 1030.

Returning again to FIG. 1, the next step in the process 1000 for improving certain characteristics of parent rolls can provides for conveying a web material to a winding process 1030. The web material that is being conveyed to a winding process 1030 can be a web material that has been just produced in situ by a papermaking machine, a web material that is has been processed by a finishing process 1020, a web material that is being conveyed from another manufacturing process, or even a convolutely wound roll that is being un-wound and re-wound to form another convolutely wound roll.

Figure 5:
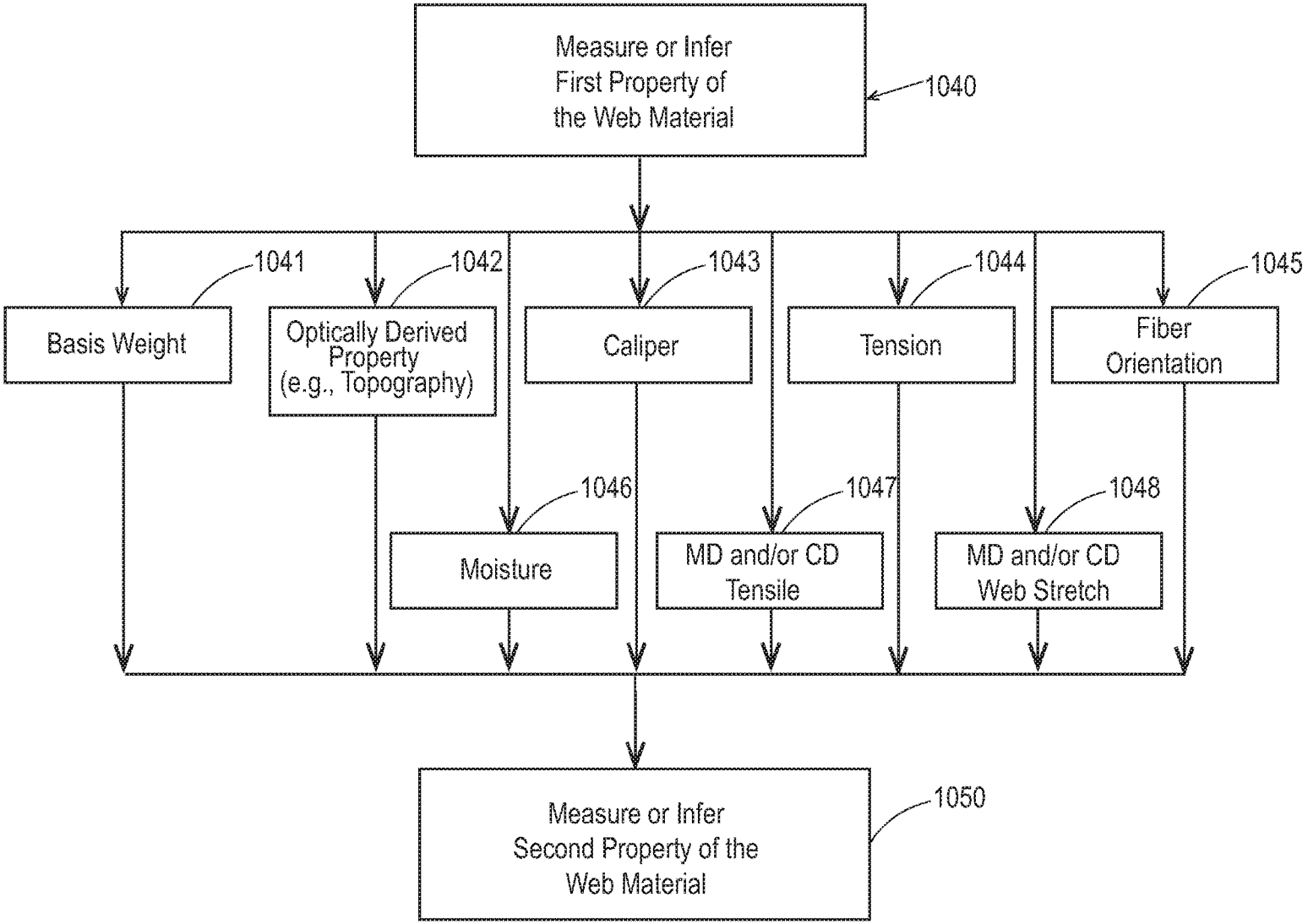
FIG. 5 is a flow chart of an exemplary process for measuring or inferring a first property of the web material consistent with the method described herein.

As shown in FIG. 5, after the last finishing process (of FIG. 4), the web material is first conveyed to a measurement station 1029 for the measurement or inference of a first physical property of the web material 1040 and then subsequently conveyed to a downstream winding process 1030. The measurement or inference of a first physical property of the web material 1040 can include the measurement of web material basis weight 1041, optically derived web material properties such as topography, crepe and/or impurities 1042, web material caliper 1043, tension 1044, fiber orientation 1045, moisture 1046, MD and/or CD tensile strength 1047, MD and/or CD web stretch 1048, and the like, and combinations thereof. The measurement of the basis weight 1041, optically derived web material properties such as topography, crepe and/or impurities 1042, web material caliper 1043, tension 1044, fiber orientation 1045, moisture 1046, MD and/or CD tensile strength 1047, MD and/or CD web stretch 1048 can be provided by one of skill in the art with equipment suitable for the measurement of such web material physical parameters as would be understood by one of skill in the art. Equipment suitable for the measurement of the basis weight 1041, optically derived web material properties such as topography, crepe and/or impurities 1042, web material caliper 1043, Tension 1044, Fiber orientation 1045, Moisture 1046, MD and/or CD Tensile Strength 1047, MD and/or CD Web Stretch 1048 can be provided as equipment that directly contacts the web material or equipment that measures the physical parameter desired on a non-contact basis.

For example, exemplary equipment can provide for one or more scanners, each of which may include one or more sensors. Each scanner can be capable of measuring one or more characteristics of the web material. For example, each scanner could include sensors for measuring the caliper, anisotropy, basis weight, contour, gloss, sheen, haze, surface features (such as roughness, topography, or orientation distributions of surface features), or any other or additional characteristics of the web material.

Each scanner can include any suitable structure or structures for measuring or detecting one or more characteristics of the web material, such as one or more sets of sensors. The use of scanners represents one particular embodiment for measuring web material properties. Other embodiments could be used, such as those including one or more stationary sets or arrays of sensors, deployed in one or a few locations across the web material or deployed in a plurality of locations across the whole width of the web material such that substantially the entire web material width is measured. An exemplary scanner can be fixed in location relative to the web material or can be moved relative to the web material in a fashion across the web material at some angle relative to the cross-machine direction. Preferably, a movable scanner would traverse the web material in the cross-machine direction.

The controller can receive measurement data from the scanners and use the data to control the paper machine 100. For example, the controller may use the measurement data to adjust any of the actuators or other components of the paper machine 100. The controller can include any suitable structure for controlling the operation of at least part of the paper machine 100, such as a computing device.

The network can be coupled to the controller and various components of the paper machine 100 (such as the actuators and scanners). The network can facilitate communication between components of the system. The network can represent any suitable network or combination of networks facilitating communication between components in the system. The network could, for example, represent a wired or wireless Ethernet network, an electrical signal network (such as a HART or FOUNDATION FIELDBUS network), a pneumatic control signal network, or any other or additional network(s).

Caliper measurements of the web material can be captured using one or more of the scanners. Conventional caliper sensors are often classified as full contact, semi-contact, or contactless. In a full contact caliper sensor, the sensor physically contacts both sides of a web material. In a semi-contact caliper sensor, the sensor physically contacts one side of a web material. In either case, material from the web material can foul the sensor, creating a bias over time. These types of sensors also typically create undesirable marks on the web material, increase the risk of web material breaks, and cannot provide reliable measurements near the web material edges. Non-contact caliper sensors do not physically contact either side of the web material. Instead, conventional noncontact caliper sensors typically project a spot onto each side of the web material and perform triangulation to measure the web material caliper. However, these sensors typically require that the spots be aligned on both sides of the web material, and they are highly vulnerable to misalignment between the spots. This can be particularly problematic if the web material flutters or otherwise moves near the sensor.

In accordance with this disclosure, one or more of the scanners can include at least one noncontact caliper sensor that projects illumination lines onto the web material and measures the web material caliper at the intersection of those lines. The use of intersecting lines avoids the problems associated with misalignment of spots. Moreover, the use of a noncontact sensor avoids problems such as bias caused by fouling, web material marking, and web material breakage. In addition, this technique can be implemented using commercially available cameras, lasers, and optics, which can help to reduce the cost associated with the sensor.

One or more caliper sensors can be deployed at one or several fixed locations across the width of the web material, or a caliper sensor can traverse some or all of the width of the web material. Caliper sensors that traverse some or all of the width of the web can incorporate methods to correct for variations in the distance between the two lasers as the sensors traverse the web automatically correcting for these variations. The web material caliper and its variation may be measured and expressed in any suitable manner, such as a function of time and/or position. The caliper measurements can be provided to the controller and used to adjust operation of the system.

Figure 6:
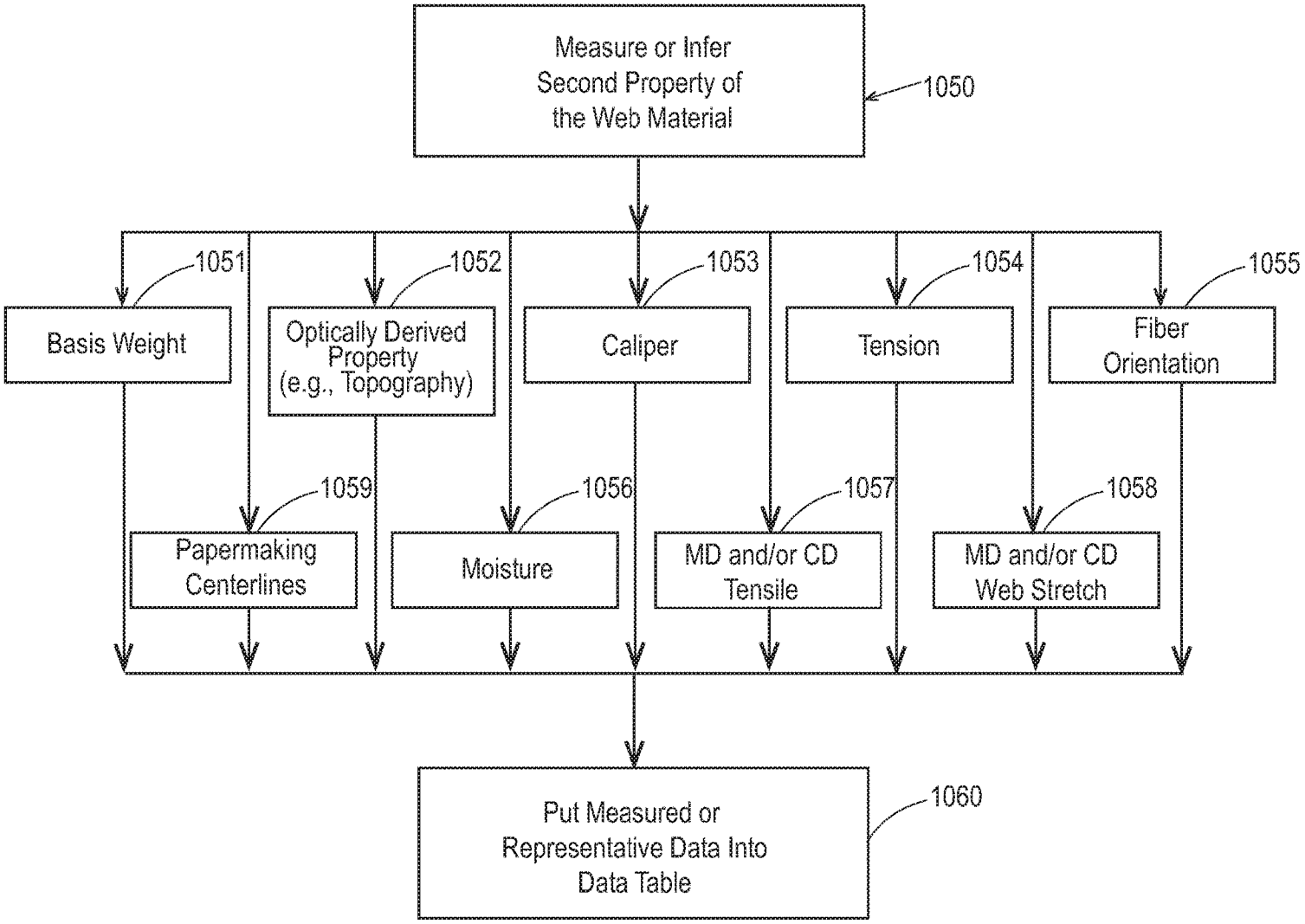
FIG. 6 is a flow chart of an exemplary process for measuring or inferring a second property of the web material consistent with the method described herein.

Returning to FIG. 1, after the step of the measurement or inference of a first physical property of the web material 1040, the process 1000 for improving certain characteristics of parent rolls next provides for a second physical property of the web material 1050 to be measured measured. As shown in FIG. 6, the measurement or inference of a second physical property of the web material 1050 can include the measurement of web material basis weight 1051, derived properties (e.g., optically derived properties) web material topography 1052, web material caliper 1053, tension 1054, fiber orientation 1055, moisture 1056, MD and/or CD tensile strength 1057, MD and/or CD web stretch 1058, the papermaking machine centerlines 1059 (which can also be used by one of skill in the art to create a stronger factor-effects relationship for the machine to further optimize the process described herein), and the like, and combinations thereof.

The measurement of the basis weight 1051, web material topography 1052, web material caliper 1053, tension 1054, fiber orientation 1055, moisture 1056, MD and/or CD tensile strength 1057, MD and/or CD web stretch 1058 can be provided by one of skill in the art with equipment suitable for the measurement of such web material physical parameters as would be understood by one of skill in the art in a manner commensurate in scope with the step of the measurement or inference of a first physical property of the web material 1040. By way of non-limiting example, equipment suitable for the measurement of the basis weight 1041, derived web material properties (e.g., optically derived properties) such as topography, crepe and/or impurities 1042, web material caliper 1043, tension 1044, fiber orientation 1045, moisture 1046, MD and/or CD tensile strength 1047, MD and/or CD web stretch 1048 can be provided as equipment that directly contacts the web material or equipment that measures the physical parameter desired on a non-contact basis. Exemplary equipment and the process for the use of such equipment are discussed supra.

Exemplary papermaking machine centerlines 1059 that can be measured or can be inferred can include such factors as furnish composition, creping blade set-up/angle, Yankee glue composition, Yankee glue addition rate, after pre-dryer moisture (i.e., pre-Yankee moisture), vacuum application pressures, wire-to-press draw (i.e., the differential speed between wire and press sections), wet-transfer moisture content, pressure roll loading, dry end draws, the like, and combinations thereof.

The measurement of papermaking machine centerlines 1059 can be provided by one of skill in the art with equipment suitable for the measurement or inference of such web material physical parameters as would be understood by one of skill in the art in a manner commensurate in scope with the step of the measurement or inference of furnish composition, creping blade set-up/angle, Yankee glue composition, Yankee glue addition rate, after pre-dryer moisture, vacuum application pressures, wire-to-press draw, wet-transfer moisture content, pressure roll loading, dry end draws, the like, and combinations thereof.

As would be understood by one of skill in the art, after the step of the measurement or inference of a second physical property of the web material 1050, the process 1000 for improving certain characteristics of parent rolls next can provide for any number of physical property of the web material 1050 to be measured and/or inferred (e.g., a third physical property, a fourth physical property, a fifth physical property, . . . an $X^{th}$ physical property).

The measurement and/or inference of the required physical properties of the web material can be provided by one of skill in the art with equipment suitable for the measurement of such web material physical parameters as would be understood by one of skill in the art in a manner commensurate in scope with the step of the measurement or inference of the required number of physical properties of the web material. Exemplary equipment and the process for the use of such equipment are discussed exhaustively supra.

Returning again to FIG. 1, the process 1000 for improving certain characteristics of parent rolls next provides for the step of placing the measured or inferred (i.e., representative) data into a data table 1060. The step of placing the measured or inferred data into a data table 1060 can include directly entering the data from the manufacturing and/or conveying and/or measurement/inference process (e.g., automatically populating data table) and/or manually entering manufacturing and/or conveying and/or measurement/inference process data into a data table. One of skill in the art will recognize that such data can be 'pre-filtered' data (i.e., averaged over time). This pre-filtering can be accomplished by applying software filters that can execute the process of filtering or aggregating the data (i.e. averaged over time, sampled less frequently, or the like). Alternatively, one skilled in the art could also apply a set of limits to the variables that prevent further sampling data from being collected until the process value exceeds one of the limits (high or low).

Figure 7:
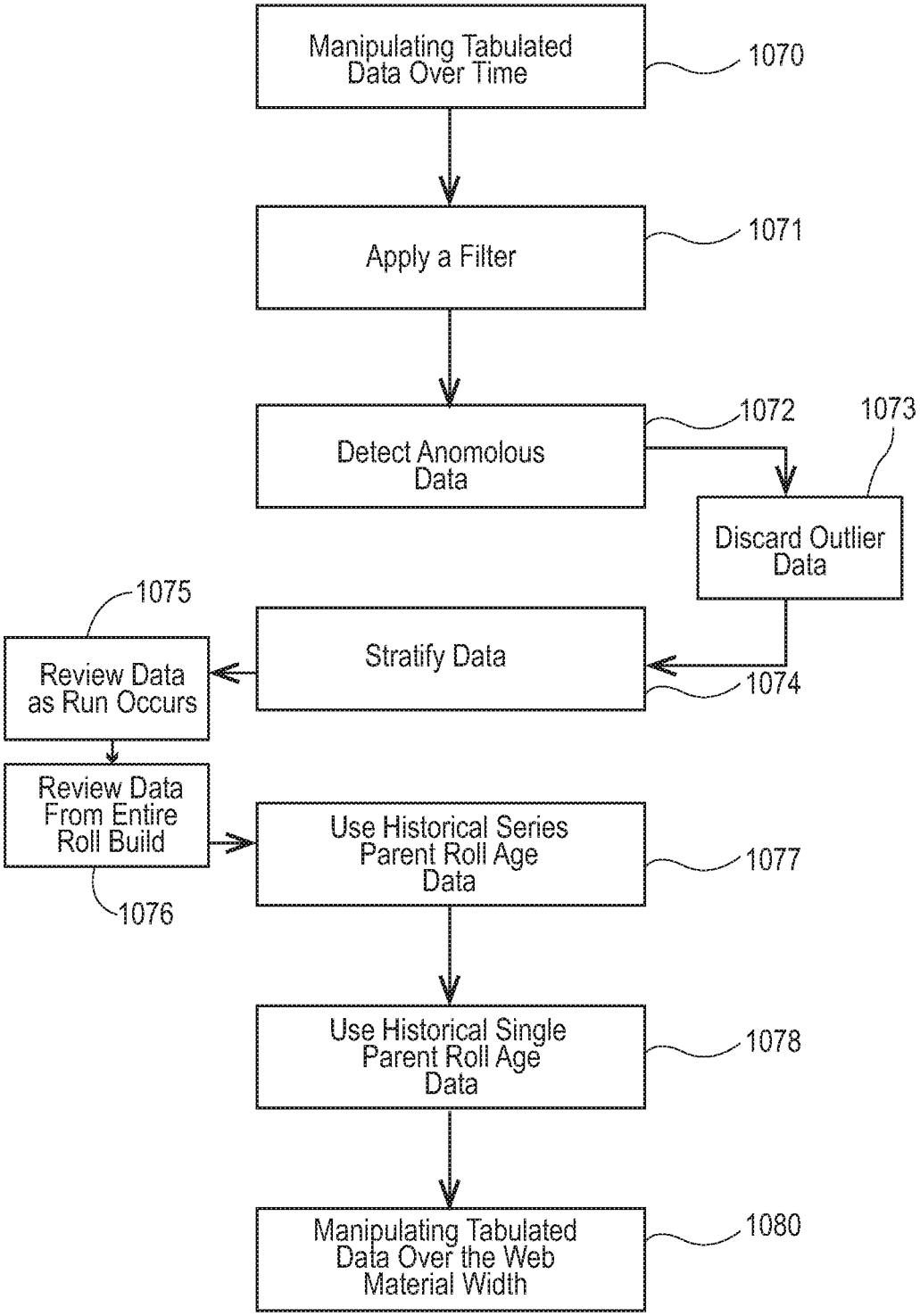
FIG. 7 is a flow chart of an exemplary process for manipulating tabulated data over time consistent with the method described herein.

As shown in FIG. 1, the process 1000 for improving certain characteristics of parent rolls next provides for the step of manipulating the data across the width of the web for each measured or inferred physical property of the web material over time 1070. As used herein, "manipulating data" can include, by non-limiting example, aggregating, sub-aggregating, mathematically weighting, and the like as would be understood by one of skill in the art. FIG. 7 provides the steps that can be used to average data for each measured or inferred physical property over time across the width of the web material 1070. First, a filter may be applied to the collected data 1071. This filter could be designed by one of skill in the art to eliminate data considered noise to the system (i.e. data significantly outside of the normal operating range, data where the transmitter was out of its calibrated range, etc.) by using a pre-defined set of rules to eliminate this data.

Next, anomalous data is detected 1072. Anomalous data can be defined as the data that deviates from, or is inconsistent with, the typical steady state process. Without desiring to be bound by theory, this data is can be the result of errors, abnormal situations or unusual events that occur in the course of executing a process like process 1000. One of skill in the art could detect this anomalous data by either: 1. Using historical data and applying statistical process control principles to identify or correct any outlier data or, 2. monitoring the sensor performance and noting any faults or errors in the sensing element that would lead to erroneous data. This is done because we know there are occasions (due to equipment limitations/failures, process transients, etc.) that cause data anomalies to occur. These are not always truly representative of the ongoing process and must be dealt with to avoid over-controlling the process.

Next, any poor or outlying data is discarded 1073. Initially the discard process could happen on a manual basis in the process of correlating the data to our manually measured/inferred paper properties. After the initial correlation, a supplementary algorithm can be written to automatically ignore data based on some predefined criteria set by those skilled in the art. Alternatively, a method that can be employed by one skilled in the art is that all data is accepted (beyond that which can be filtered out by properly calibrating the sensing equipment) and then the final data coming from the correlated expression is noted, when the erroneous data is generated, that triggers a supplementary investigation as to the cause of the erroneous data. Determining the cause of the erroneous data is integral to the ongoing stability of process 1000 due to the need to minimize overall process disturbances.

Next, the collected data is stratified 1074. This is accomplished by reviewing the collected and/or inferred data as the run occurs 1075 and/or by reviewing the collected and/or inferred data within a complete parent roll build 1076. Typically this could be done by grouping the data into blocks by parent roll, or sections of parent rolls, or alternatively by time block for easy handling of the data.

Next, the manipulating process 1070 can use the historical age data of a series of parent rolls 1077 as discussed supra. Finally, one of skill in the art would recognize that the manipulating process can use the historical single parent roll age data 1078 as discussed supra.

Figure 8:
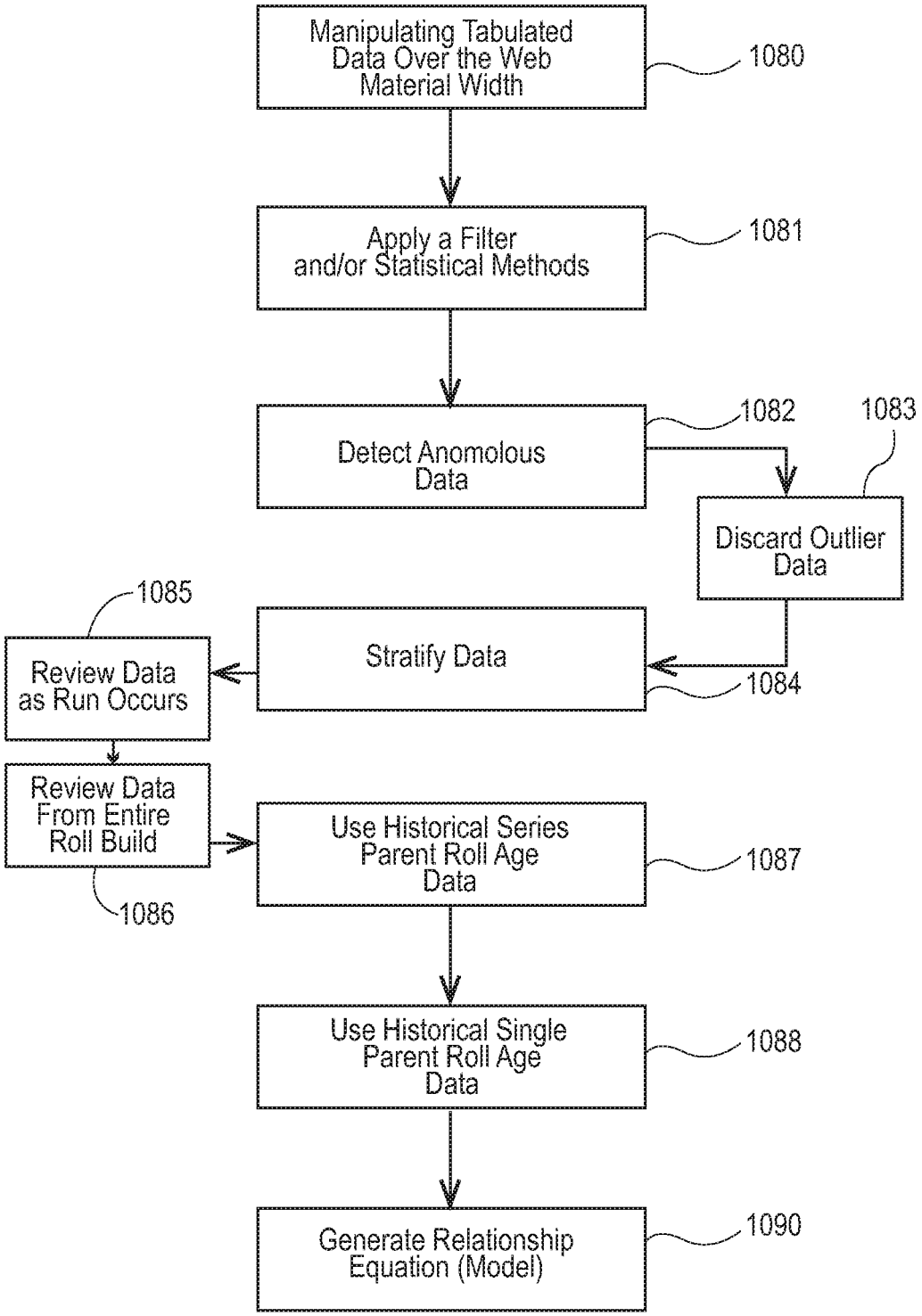
FIG. 8 is a flow chart of an exemplary process for manipulating tabulated data over the web material width consistent with the method described herein.

Next, as shown in FIG. 1, the process 1000 for improving certain characteristics of parent rolls next can provide for the step of manipulating the data for each measured or inferred physical property of the web material over the width of the web material 1080. Similar to the process associated with the manipulation of data for each measured or inferred physical property of the web material over time 1070, FIG. 8 provides the steps that can be used to average data for each measured or inferred physical property across the width of the web material 1080. First, a filter is applied to the collected data 1081. Software filters that execute the process of filtering or aggregating the data (i.e. averaged over time, sampled less frequently or the like). Alternatively, one skilled in the art could also apply a set of limits to the variables that prevent further sampling data from being collected until the process value exceeds one of the limits (high or low).

Next, anomalous data is detected 1082. Anomalous data is defined as the data that is deviant from or inconsistent with the typical steady state process. This data is usually the result of errors, abnormal situations or unusual events that occur in the course of executing a process like process 1000. This data could be detected by either using historical data or applying statistical process control principles to identify or correct outlier data or by monitoring the sensor performance and noting any faults or errors in the sensing element that would lead to erroneous data. This is done because we know there are occasions (due to equipment limitations/failures, process transients, etc.) that cause data anomalies to occur. These are not always truly representative of the ongoing process and must be dealt with to avoid over-controlling the process.

Next, poor or outlying data is discarded 1083. Initially the discard could happen on a manual basis in the process of correlating the data to our manually measured/inferred paper properties. After the initial correlation, a supplementary algorithm can be written to automatically ignore data based on some predefined criteria set by those skilled in the art. An alternative method that can be employed by one skilled in the art is that all data is accepted (beyond that which can be filtered out by properly calibrating the sensing equipment) and then the final data coming from the correlated expression is noted when erroneous which triggers a supplementary investigation as to the cause of the erroneous data. Determining the cause of the erroneous data is integral to the ongoing stability of process 1000 due to the need to minimize overall process disturbances.

Next, the collected data is stratified 1084. This is accomplished by reviewing the collected and/or inferred data as the run occurs 1085 and/or by reviewing the collected and/or inferred data within a complete parent roll build 1086. Typically this could be done by grouping the data into blocks by parent roll, or sections of parent rolls, or alternatively by time block for easy handling of the data.

Figure 9:
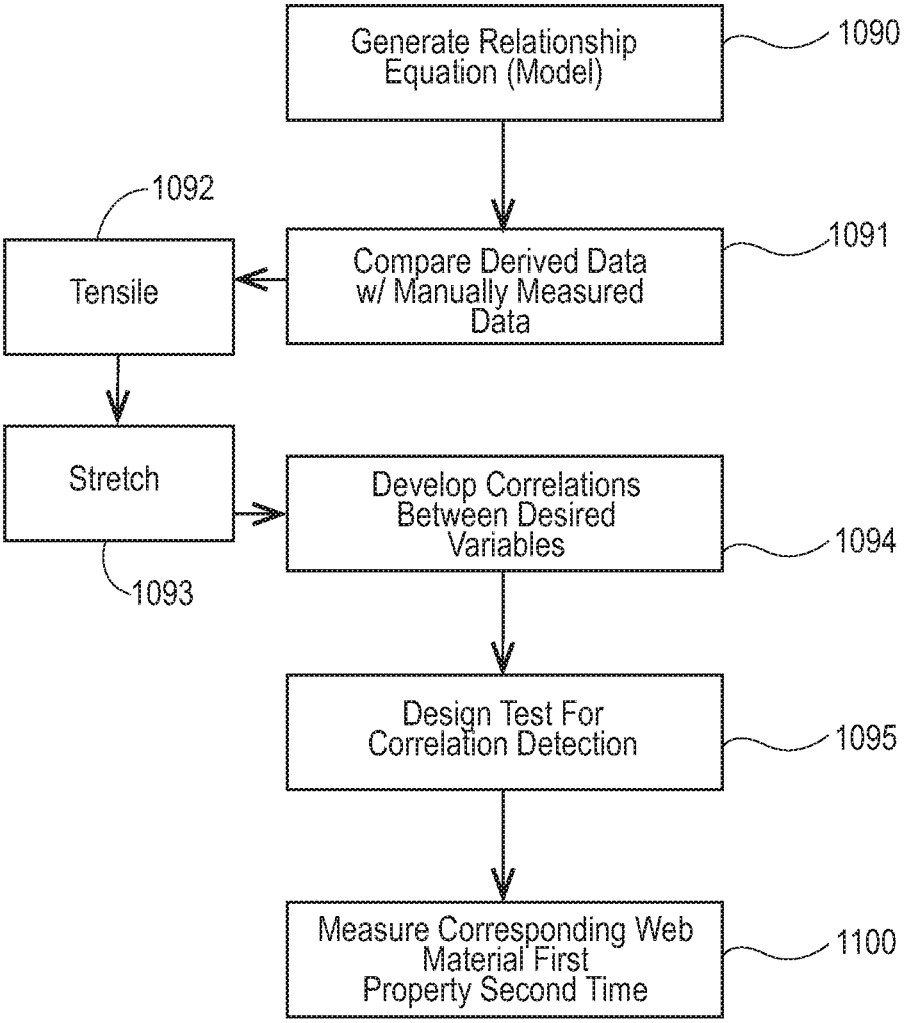
FIG. 9 is a flow chart of an exemplary process for generating an exemplary relationship equation (model) consistent with the method described herein.

Next, the manipulation process 1080 can use the historical age data of a series of parent rolls 1087 as discussed supra. One of skill in the art would recognize that the manipulation process can use the historical single parent roll age data 1088 as discussed supra Next, as shown in FIG. 1, the process 1000 for improving certain characteristics of parent rolls next provides for the step of generating a relationship equation (model) 1090 for each of the averaged measured properties that correlates each of the $X^{th}$ measured properties to web stretch based upon previous run data. As shown in exemplary FIG. 9, the step of generating a relationship equation (model) 1090 for each of the averaged measured properties in and of itself comprises several distinct processes.

First, the process of generating a relationship equation (model) 1090 can provide for the comparison of the averaged tabulated data over time 1070 to manually measured data 1091. Initially this comparison will be done by inspecting the data over time, typical inspections like this can be done in a spreadsheet-based fashion, or graphically, and looking for immediate trends in the data before proceeding to the more statistical correlations. This initial comparison can be focused on looking for possible correlations between the physical property of the web material that is measured to tensile strength 1092 and/or web material stretch 1093. This could be done by focusing on the tensile strength 1092 and web material stretch 1093 trends as compared to the measured and/or inferred physical paper properties. After the initial inspection, an analysis tool can then be used to develop correlations between these desired variables 1094 The statistical analysis tool used would consist of a third party application (typically JMP or the like) designed specifically to identify data correlations, or a more simple spreadsheet-based curve-fitting of the measured/inferred parameters to the desired parameter(s). Alternatively, one skilled in the art could employ alternate technical methods that rely more on the modelling and simulation techniques to determine the variable correlations.

Optionally, using a statistical method, the generation of a relationship equation (model) provides for the design of a test that detects correlations between measured variables and actual web properties 1095. This supplementary experiment could be designed to generate conditions that intentionally vary the measured paper properties tensile strength 1092 and web material stretch 1093, using process changes designed by those skilled in the art, and use the measured/inferred properties that result from the test. These results could then be administered through the correlation processes mentioned above.

Figure 10:
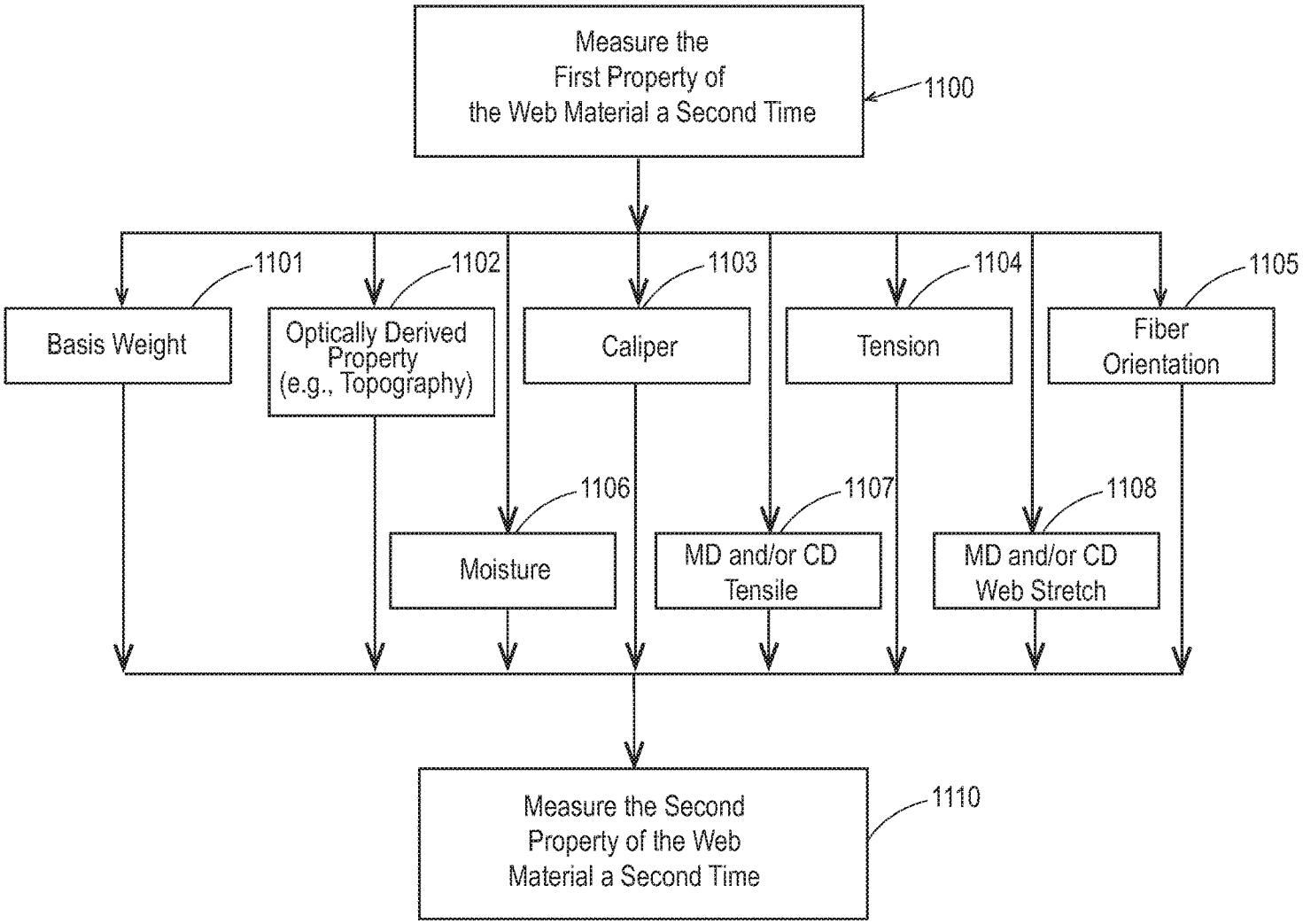
FIG. 10 is a flow chart of an exemplary process for measuring the first property of the web material a second time consistent with the method described herein.

Referring again to FIG. 1, the process 1000 for improving certain characteristics of parent rolls next provides for the step of measuring the first property of the web a second time 1100. As shown in FIG. 10, the measurement of the first physical property of the web material a second time 1100 can include the measurement of web material basis weight 1101, determined property (e.g., optically derived properties) such as web material topography 1102, web material caliper 1103, tension 1104, fiber orientation 1105, moisture 1106, MD and/or CD tensile strength 1107, MD and/or CD web stretch 1108, and the like, and combinations thereof. The measurement of the web material basis weight 1101, web material topography 1102, web material caliper 1103, tension 1104, fiber orientation 1105, moisture 1106, MD and/or CD tensile strength 1107, MD and/or CD web stretch 1108 can be provided by one of skill in the art with equipment suitable for the measurement of such web material physical parameters as would be understood by one of skill in the art. Equipment suitable for the measurement of the web material basis weight 1101, determined property (e.g., optically derived properties) such as web material topography 1102, web material caliper 1103, tension 1104, fiber orientation 1105, moisture 1106, MD and/or CD tensile strength 1107, MD and/or CD web stretch 1108 can be provided as was discussed in detail supra.

Figure 11:
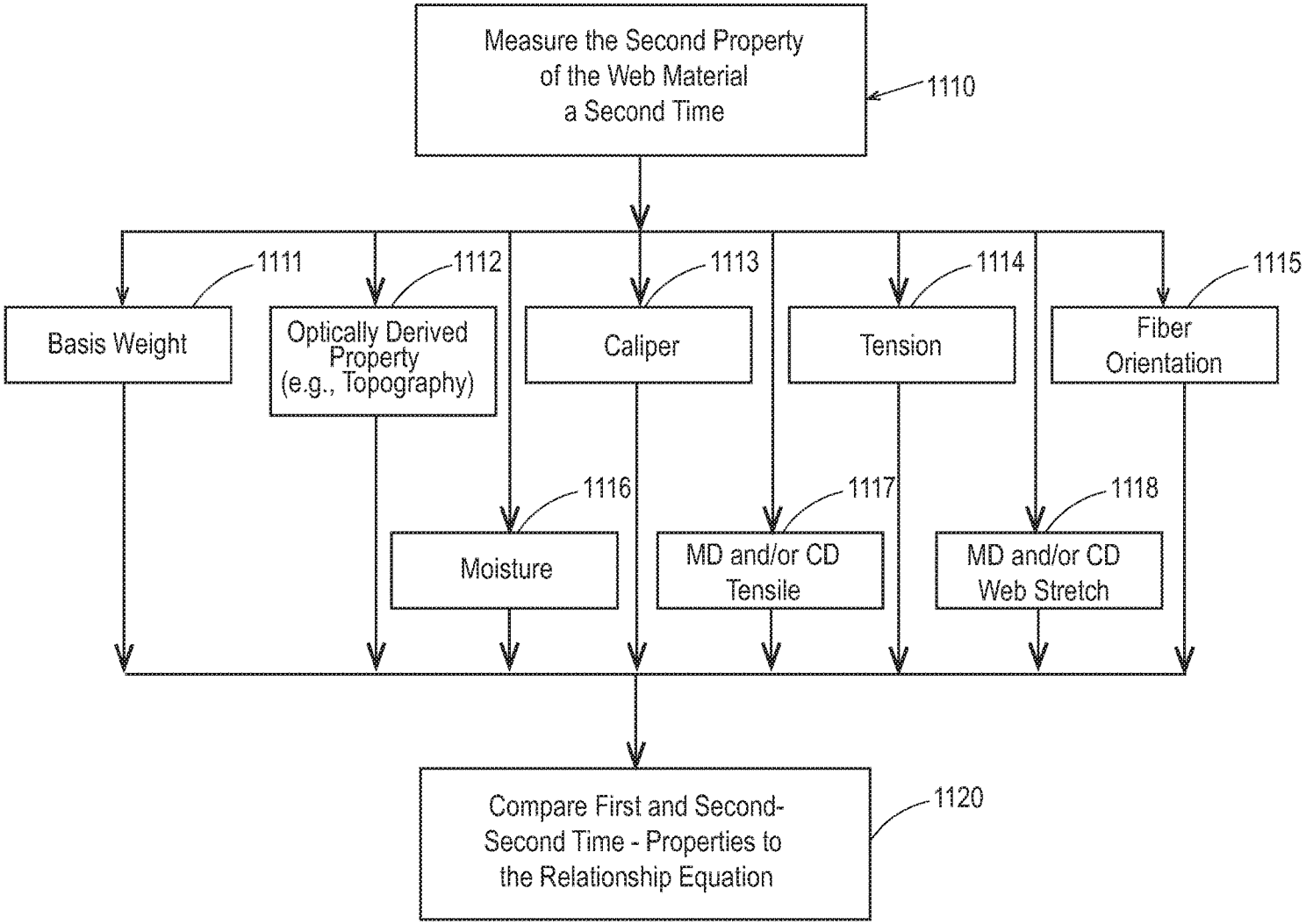
FIG. 11 is a flow chart of an exemplary process for measuring the second property of the web material a second time consistent with the method described herein.

Next, the process 1000 for improving certain characteristics of parent rolls shown in FIG. 1 next provides for the step of measuring the second property of the web a second time 1110. Referring to FIG. 11, the measurement of the second physical property of the web material a second time 1110 can include the measurement of web material basis weight 1111, determined property (e.g., optically derived properties) such as web material topography 1112, web material caliper 1113, tension 1114, fiber orientation 1115, moisture 1116, MD and/or CD tensile strength 1117, MD and/or CD web stretch 1118, and the like, and combinations thereof. The measurement of the web material basis weight 1111, determined property (e.g., optically derived properties) such as web material topography 1112, determined property (e.g., optically derived properties) such as web material caliper 1113, tension 1114, fiber orientation 1115, moisture 1116, MD and/or CD tensile strength 1117, MD and/or CD web stretch 1118 can be provided by one of skill in the art with equipment suitable for the measurement of such web material physical parameters as would be understood by one of skill in the art. Equipment suitable for the measurement of the web material basis weight 1111, determined property (e.g., optically derived properties) such as web material topography 1112, web material caliper 1113, tension 1114, fiber orientation 1115, moisture 1116, MD and/or CD tensile strength 1117, MD and/or CD web stretch 1118 can be provided as was discussed in detail supra.

As would be understood by one of skill in the art, after the step of the measurement or inference of the second physical property of the web material a second time 1110, the process 1000 for improving certain characteristics of parent rolls next can provide for any number of physical properties of the web material to be measured and (e.g., a third physical property, a fourth physical property, a fifth physical property . . . an $X^{th}$ physical property—all measured a second time).

Figure 12:
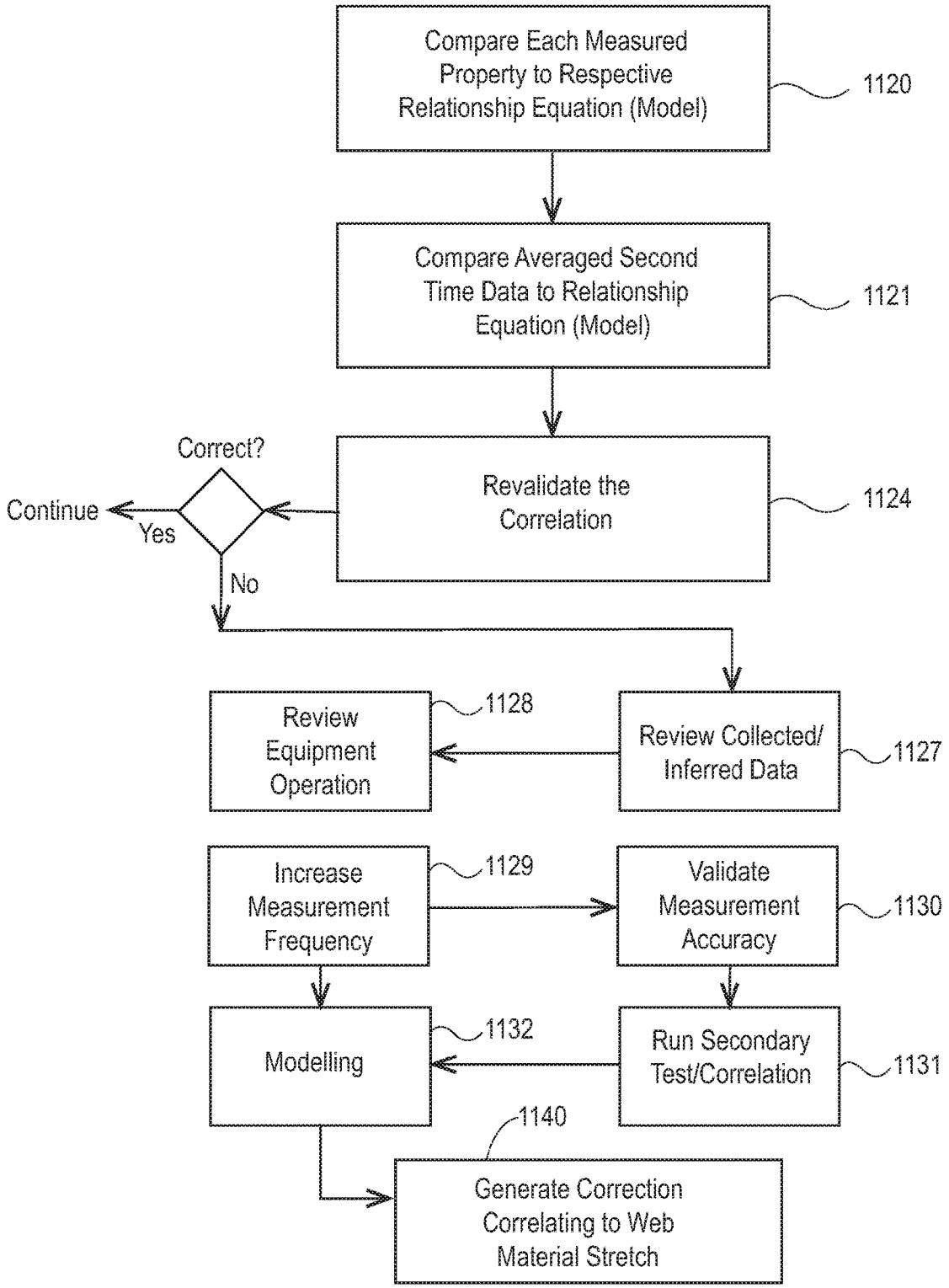
FIG. 12 is a flow chart of an exemplary process for comparing each measured property to the respective relationship equation (model) consistent with the method described herein.

Next, the process 1000 shown in FIG. 1 next provides for the step of comparing the second time measurements of the first and second physical properties 1100, 1110 to the relationship equation (model) 1120. As shown in FIG. 12, the step of comparing the second time measurements of the first and second physical properties 1100, 1110 to the relationship equation (model) 1120 first provides for the step of comparing the averaged second time measurements 1100, 1110 to the relationship equation (model) 1121. This comparison can be provided by inserting the second-time measured and/or inferred variables into the first-time correlation and the comparing the resulting values to the physically measured properties tensile strength 1092 and web material stretch 1093. This step is preferably executed over a range of inputs over time.

After the comparison of the respective physical properties measured the second time 1100, 1110 to the relationship equation (model), two scenarios can result. First, if the comparison of the respective physical properties measured the second time 1100, 1110 to the relationship equation (model) provides a revalidation of the correlation 1124 no correction is needed to the papermaking process and the web material can be convolutely wound to provide a parent roll for a converting operation. After completing this validation test, one skilled in the art could use statistical methods to evaluate the actual error in the correlation relative to the expected error for correlations that are generally considered acceptable in the industry.

However, if no re-validation of the correlation 1124 is found (i.e., the correlation (model) is incorrect) then an alternative course of action can be enacted to provide a correlation capable of being validated.

First, if the correlation is not validated, the collected or inferred data used to generate relationship equation (model) should be reviewed 1127. It could be revealed in the review process that certain mechanical operations of the papermaking and/or processing equipment may be operating outside of their defined centerlines 1128. If the mechanical operations of the papermaking and/or processing equipment are operating outside of certain centerlines, they should be returned to compliant operation.

Additionally, it may be necessary to increase the measurement frequency 1129 of the data collection equipment. For example, if there are manufacturing anomalies, substrate anomalies, and the like, providing an increased number of data points for the respective physical properties measured the second time 1100, 1110 may be able to adapt to these anomalies and provide for smoother transitions from one manufacturing state to another. Similarly, it may be necessary to validate measurement accuracy 1130 of the equipment used to measure the respective physical properties 1100, 1110.

Additionally, it may be appropriate to complete a secondary test/correlation 1131. This could require the user to generate a relationship equation (model) for the averaged measured properties that correlates to the physically measured properties tensile strength 1092 and web material stretch 1093. This process is similar to process step 1090 discussed supra and the steps that follow. Following this correlation determination, a tertiary set of data will be collected similar to step 1100, discussed supra and the steps that follow. A second validation attempt will be executed to determine if there is a correlation between the values determined for the second and third data sets similar to what was discussed supra.

Additionally, it may prove advisable to broaden the sample size used in the correlation and validation attempts to span a longer period of time. This could be advisable if there were short term process noise that could be artificially increasing the standard deviation of the measured/inferred properties of the web, or if there was some natural process oscillation that wasn't properly represented in the previous data sets.

Finally, the user could further enlist modeling techniques 1132 to determine physics/correctness of variables chosen. This would be done in concert with those skilled in the art of modeling and simulation to develop a deeper understanding of the process interactions resulting in a more accurate correlation.

Next, the process 1000 shown in FIG. 1 provides for the step of utilizing the corrected model for each measured property to create a control algorithm 1150 for the web property that minimizes the variability of that correlated property (can be the desired stretch). This algorithm could be created to control a process knob defined by one skilled in the art to achieve a defined centerline for the correlated property. This could be done in the fashion of an industry standard control loop scheme (PID-type or the like).

Figure 13:
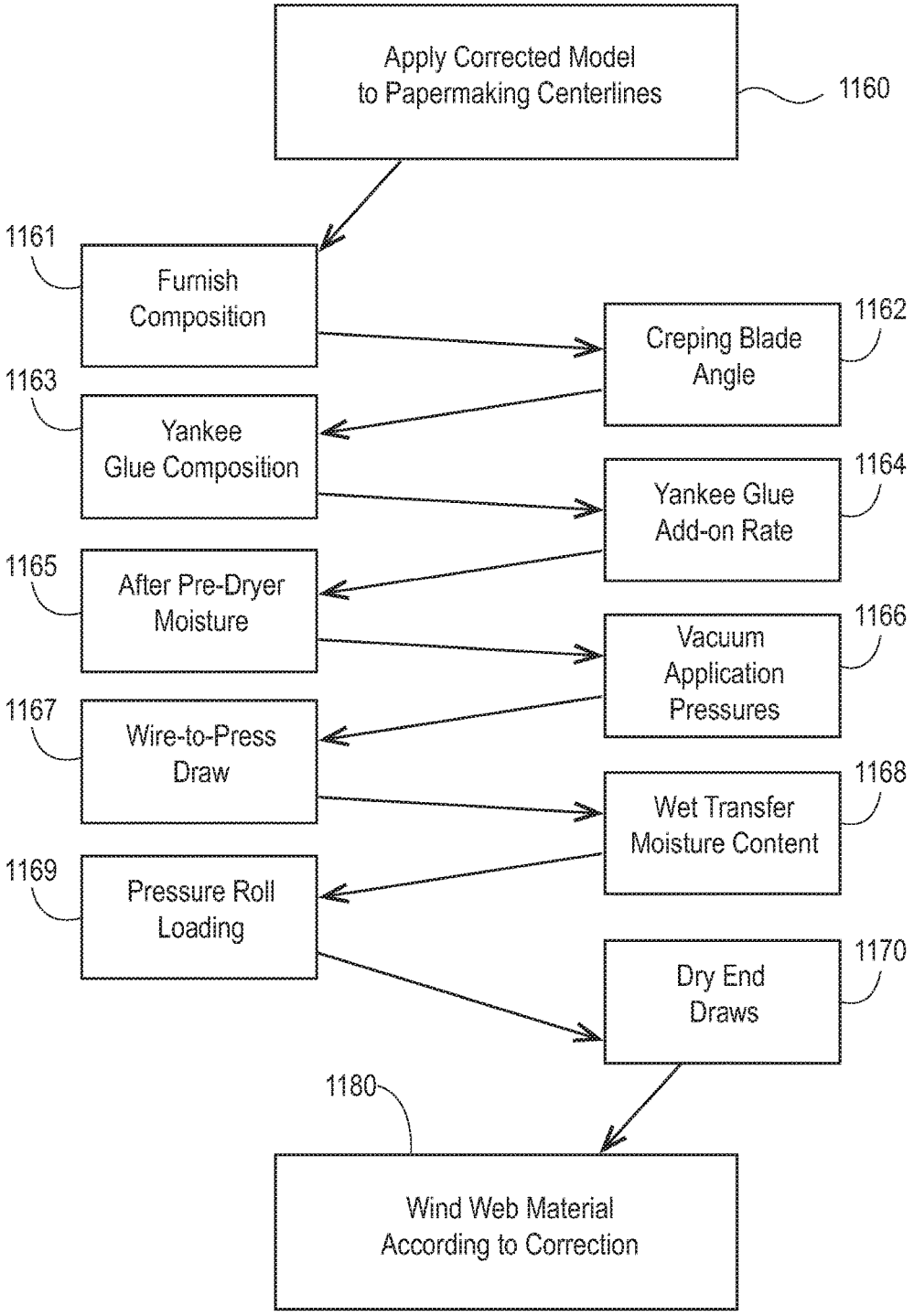
FIG. 13 is a flow chart of an exemplary process for applying a corrected relationship equation (model) to papermaking centerlines consistent with the method described herein.

Next the process 1000 shown in FIG. 1 can provide for the step of applying the corrected model to the papermaking process centerlines 1160. As shown in FIG. 13, exemplary, but non-limiting, papermaking centerlines that could be adjusted can include changes to the papermaking furnish composition 1161, creping blade set-up/angle 1162, Yankee glue composition 1163, Yankee glue addition rate 1164, after pre-dryer moisture (pre-Yankee moisture) 1165, vacuum application pressures 1166, wire-to-press draw (e.g., differential speed between wire and press sections) 1167, wet-transfer moisture content 1168, pressure roll loading 1169, dry end draws 1170, combinations thereof, and the like. The application of the model in the adjustments of these centerlines can be the result of a designed test that involves the manipulation of selected papermaking centerlines (including but not limited to those discussed supra) and subsequent correlation of the resulting measured properties (tensile strength 1092 and web material stretch 1093) to the magnitude of centerline adjustment. These correlations can be used to update current machine control strategies for the purpose of improvement of the produced parent roll characteristics.

Finally, the process 1000 shown in FIG. 1 can provide for the step of winding the web material into a convolutely wound roll according to the web property correction determined supra.

Figure 14:
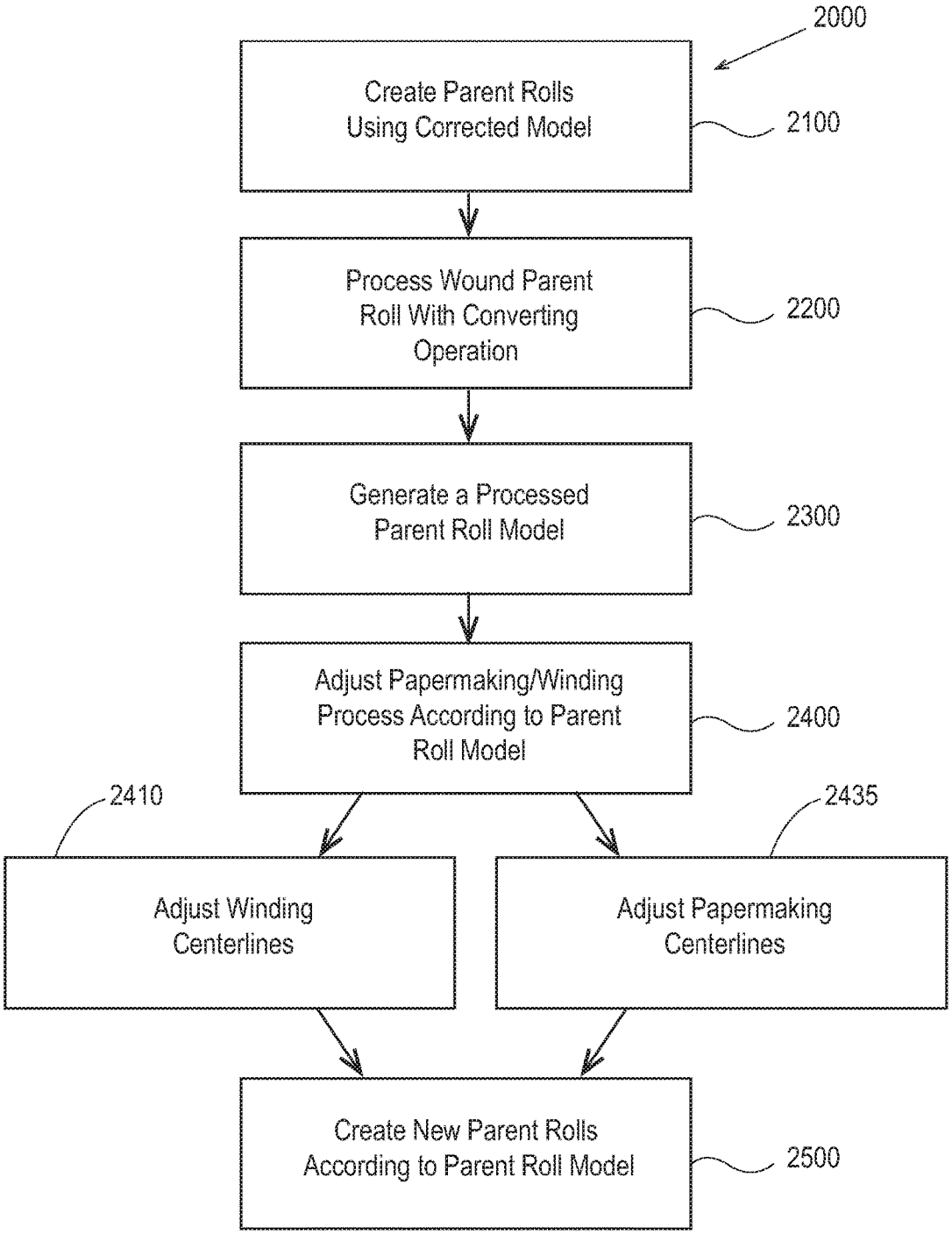
FIG. 14 is a flow chart of an exemplary process for creating parent rolls of convolutely wound web material using the corrected relationship equation (model) consistent with the method described herein.

As is shown in FIG. 14, the process 1000 for improving certain characteristics of parent rolls can be utilized in a process to create parent rolls 2000 that have improved converting characteristics. As discussed supra, parent rolls having improved converting characteristics make the parent roll so produced extremely desirable for a particular downstream converting process. Parent rolls so improved can provide the downstream converting operations with a better quality material that experiences less break-outs as well as other issues that can occur in downstream converting.

The process to create such improved parent rolls 2000 first provides that the user create parent rolls that using corrected model 2100. This process of creating parent rolls using the corrected model 2100 can minimize the variability of that correlated property. For example, the correlated property can be a desired stretch characteristic of the web material disposed upon the parent roll. In this regard, it can be helpful to produce parent rolls on a reel using the corrected model 1000 approach.

The next step of the process to create improved parent rolls 2000 provides for processing the wound parent rolls with some web material converting operation 2200. Exemplary, but non-limiting web material converting operations 2200 may include calendaring, slitting, folding, web, embossing and/or laminating, printing, combining, combinations thereof, and the like. From this web material converting operation, it is possible to collect process data from the processing of the parent rolls. Exemplary process data from the converting of wound parent rolls of web material can include items such as winder setup centerlines, web tension & draw centerlines and the like.

Figure 15:
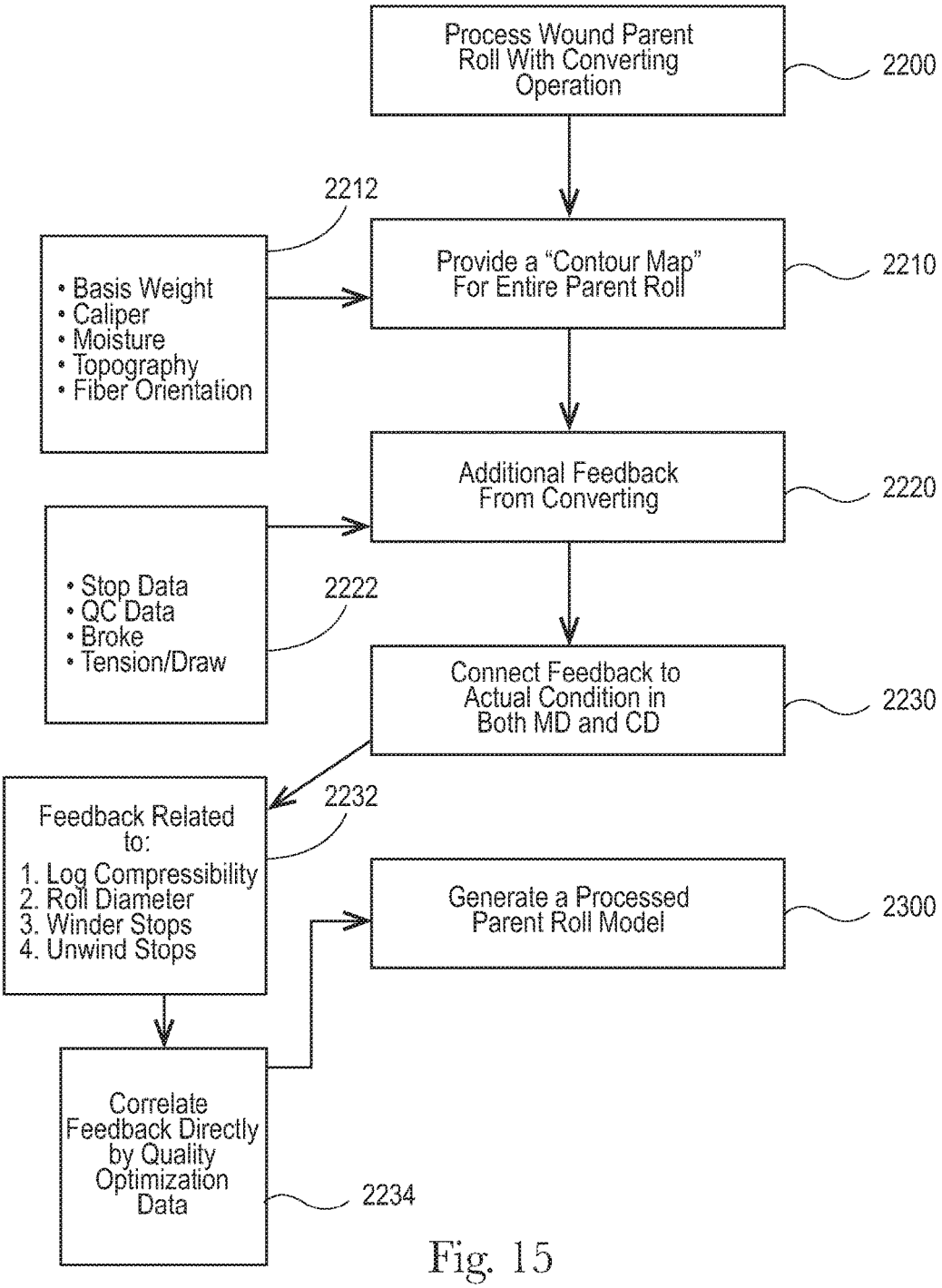
FIG. 15 is a flow chart of an exemplary process for processing a wound parent roll of web material with a converting operation consistent with the method described herein.

As shown in FIG. 15, processing the wound parent rolls with some web material converting operation 2200 can include several options to improve the run-ability and/or processability of wound parent rolls in a converting operation based upon the data that is collected during the development of a wound parent roll of web material. First, the collected data can be sent directly to a converting operation to get immediate feedback. This immediate run-ability and/or processability feedback can be provided by converting when a "contour map" is provided to converting for the entire parent roll 2210. In practice a "contour map" 2210 is a mapping of selected measured properties of an MD length of web material used to form a wound parent roll across its entire CD width. By way of non-limiting example, a "contour map" could be provided as a color map as would be understood and practiced by one of skill in the art. The measured properties 2212 can include, but not be limited to, web material basis weight, web material caliper, web material moisture content, web material surface topography, and/or web material fiber orientation.

Further, additional feedback for the run-ability of the wound parent rolls can be provided by the web material converting process 2220. Exemplary, but non-limiting, feedback 2222 from web material converting 2220 can include web material processing general stop data, web material processing general quality control data, the amount of web material broke, and web material tensions and/or draws. This data could be used by the converting operation for the purposes of troubleshooting as well as for optimization of their operating centerlines as a function of changing raw materials (in this case the parent roll quality).

It will also be understood that next, feedback can be more directly connected to an actual condition of the parent roll 2230 that is specific to each part of the parent roll in both CD and MD. This would be understood by one of skill in the art as quality optimization. In this regard feedback 2232 can be related to log compressibility, roll diameter, winder stops (e.g., a fault that shuts down a re-winding system), and/or un-wind stand stops. Exemplary, but non-limiting winder stops can be due to web material being incompressible. This is known to those of skill in the art as "break-outs" (i.e., web faults/defects). Winder stops can also be due to the web material being too compressible. Those of skill in the art will understand that this can cause general winding instability. In this manner, the feedback provided can be correlated 2234 directly to specific parent rolls to provide the requisite quality optimization data.

Alternatively, it may be advantageous to provide ageing studies on the parent rolls by placing the parent rolls into storage for a known duration and under known environmental conditions. It may be advantageous to send a parent roll to converting according to a controlled aging plan that can be based upon a known time or to review the effect of the storage environment of the parent roll. This collected property data can then be correlated to determine a relationship between the properties measured in converting and the properties measured (e.g., web material stretch and/or web material tensile strength) during papermaking, as well as to develop a deeper understanding of the ageing effects on wound parent rolls.

Similar to the process to provide converting data immediately to generate the model, the ageing study feedback can be provided by converting when a "contour map" is provided to converting for the entire parent roll. Here, the measured properties can include, but not be limited to, web material basis weight, web material caliper, web material moisture content, web material surface topography, and/or web material fiber orientation. Similar to the process discussed supra, additional feedback for the corrected model can be provided by the web material converting process. Exemplary, but non-limiting, feedback from web material converting can include web material processing general stop data, web material processing general quality control data, the amount of web material broke, and web material tensions and/or draws.

It will also be understood that next, feedback can be more directly connected to an actual condition of the parent roll that is specific to each part of the parent roll in both CD and MD. This would be understood by one of skill in the art as quality optimization. In this regard feedback can be related to log compressibility, roll diameter, winder stops (e.g., a fault that shuts down a re-winding system), and/or un-wind stand stops. Exemplary, but non-limiting winder stops can be due to web material being incompressible. This is known to those of skill in the art as "break-outs" (i.e., web faults/defects). Winder stops can also be due to the web material being too compressible. Those of skill in the art will understand that this can cause general winding instability. In this manner, the feedback provided can be correlated the feedback directly from coded parent rolls to provide the requisite quality optimization data. This collected property data can then be correlated to determine a relationship between the properties measured in converting and the properties measured (e.g., web material stretch and/or web material tensile strength) during papermaking, as well as to develop a deeper understanding of the ageing effects on wound parent rolls.

Figure 16:
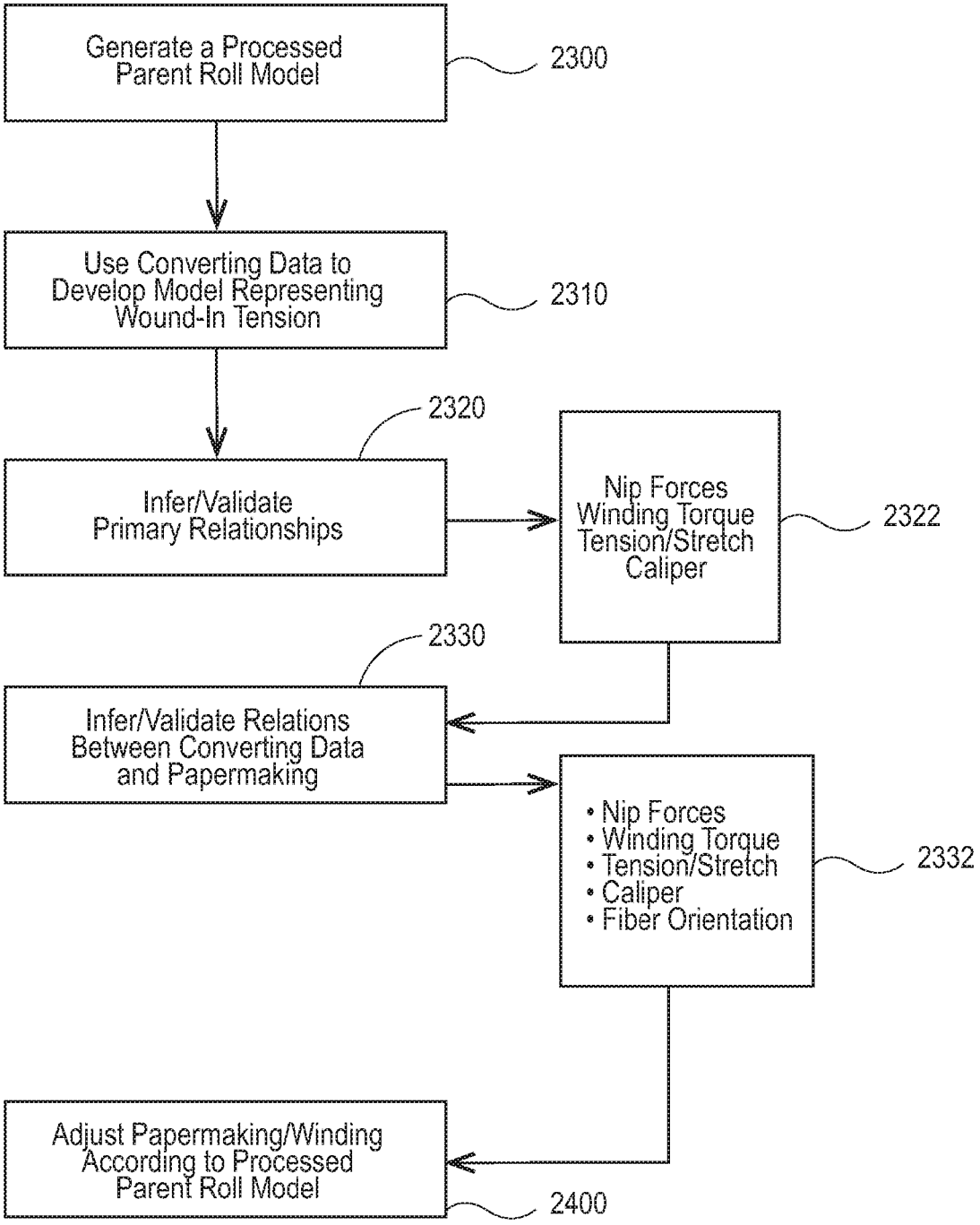
FIG. 16 is a flow chart of an exemplary process for generating a processed parent roll model consistent with the method described herein; and, FIG. 17 is a flow chart of an exemplary process for adjusting a papermaking and/or winding process according to the processed parent roll relationship equation (model) consistent with the method described herein.

Turning now to FIG. 16, the next step in creating parent rolls of web material utilizing the corrected model provides for the generation of a processed parent roll model 2300. The generation of a processed parent roll model can be provided manually or through a feedback loop. In the manual option, data is entered to refine the equation (model). The feedback loop option can provide feedback automatically in a manner that includes a feedback loop that allows equation (model) to self-refine. In any regard, the generation of the processed parent roll model 2300 generally correlates the correlated property data (e.g., stretch and/or winding centerlines) to process data (obtained from parent roll converting operations).

The step of generating a processed parent roll model 2300 generally comprises the step of using the correlated physical property data from the corrected model developed by process 1000 to develop a model/simulation that represents wound-in tension 2310. This could be accomplished through the use of techniques of those skilled in the art of modelling & simulation, including but not limited to building on existing understanding of parent roll modelling of internal wound parent roll forces and effects with the new data from the corrected model. The potential model improvements could include but are not limited to incorporating real-time data for fiber web properties over time in the MD direction of the web from process 1000

Next, the step of generating a processed parent roll model 2300 generally comprises the step of inferring and/or validating primary relationships 2320 between papermaking properties 2322 such as nip forces, winding torque, web material tension, web material stretch, and/or web material caliper. One method that could be employed to accomplish this would be to intentionally vary these centerline adjustments and measure the impacts to the wound parent rolls for variables including but not limited to processed roll weight, and visual roll wind appearance.

Next, the step of generating a processed parent roll model 2300 generally comprises the step of inferring and/or validating primary relationships 2330 between the converting process data and papermaking process data 2332 such as nip forces, winding torque, web material tension, web material stretch, web material caliper, and/or web material fiber orientation (i.e., MD/CD tensile ratio). This can be done by evaluating the feedback from the converting operation in comparison to the data processed through the parent roll model 2300 and then devising a methodology on how to adjust the papermaking winding centerlines using the best current understanding of parent roll winding of those skilled in the art.

Figure 17:
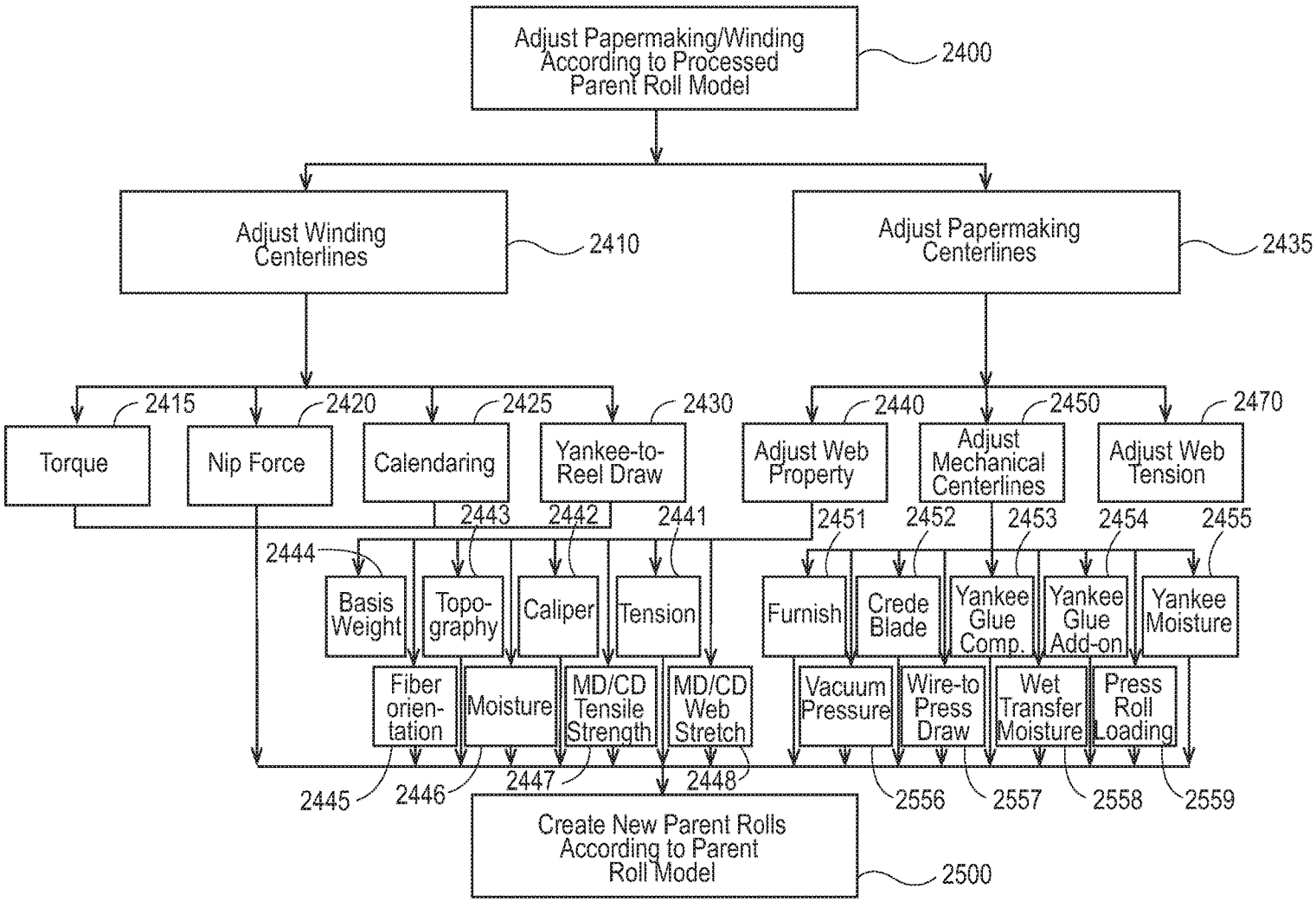

Turning now to FIG. 17, the next step in creating parent rolls of web material utilizing the corrected mode provides for the adjustment of the papermaking and/or the winding process according to processed parent roll model 2400. One of skill in the art will understand that there are three feasible manners to accomplish this step. They include the adjustment of the winding centerlines 2410, adjustment of the papermaking centerlines 2435, and/or adjustment of the tension applied to the web material.

Addressing the adjustment of the winding centerlines 2410 first, the papermaking winding centerlines can be adjusted in a manual or in a closed-loop (automatic) manner. Manual adjustment could involve entering centerline data into a the machine control system to manage the winding centerlines to the new target values, or alternatively could involve entering the centerline data into a pre-existing program in the machine control system that varies the winding centerlines through the production of the wound parent roll according to any number of operator-defined relationships. The centerlines that can be adjusted include, but are not necessarily limited to, torque 2415, nip force 2420, calendaring 2425, and/or Yankee-to-reel draw 2430. Any adjustments to the calendaring 2425 of a web material are preferably based upon caliper as this is the primary adjustment for web caliper on the paper machine and it is the most isolated caliper adjustment handle. Any adjustments to the Yankee-to-reel draw 2430 are preferably based upon the stretch of the web material as this is the main control adjustment on the paper machine for web stretch, and is a fairly isolated adjustment.

Alternatively, the process for adjustment of the papermaking and/or the winding process according to processed parent roll model 2400 allows for the adjustment of any papermaking centerlines 2435. By way of non-limiting example, the adjustment of any papermaking centerlines 2435 can include adjustment of the web material properties 2440 during the papermaking process. Corresponding web material properties that can be adjusted during the papermaking process can include, but not be limited to, basis weight 2444, topography 2443, caliper 2442, tension 2441, fiber orientation 2445, moisture 2446, MD and/or CD Tensile Strength 2447, and/or MD and/or CD Web Stretch 2448.

In yet another embodiment, the adjustment of the papermaking centerlines 2435 can provide for the adjustment of certain papermaking mechanical centerlines 2450. The papermaking mechanical centerlines that can be adjusted 2450 can include, but are not limited to, adjustment of the papermaking furnish composition 2451, creping blade set-up and/or angle 2452, Yankee glue composition 2453, Yankee glue addition rate 2454, after pre-dryer moisture 2455 (i.e., pre-Yankee moisture), vacuum application pressures 2456, wire-to-press draw 2457 (i.e., adjustment of any differential speed between the papermaking wire and press sections), wet-transfer moisture content 2458, pressure roll loading 2459.

Alternatively, the process for adjustment of the papermaking and/or the winding process according to processed parent roll model 2400 can allow for the adjustment of any converting centerlines. This can include any adjustments to the wound web material log winding profile, any web material chop-off/transfer profiles, any web material choke belt tensions, combinations, thereof, and the like.

After implementation of the corrected model that minimizes the variability of the correlated web material property (ies), one of skill in the art can now create new parent rolls according to the parent roll model 2500.

Any dimension and/or value disclosed herein is not to be understood as strictly limited to the exact numerical values recited. Instead, unless otherwise specified, each dimension and/or value is intended to mean both the recited dimension and/or value and a functionally equivalent range surrounding that dimension and/or value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this is invention.

What is claimed is:

1. A process for adjusting a papermaking process for producing parent rolls of convolutely wound web material having a machine direction (MD) and a cross-machine direction (CD) coplanar and orthogonal thereto that improves the characteristics of the parent rolls of wound web material to improve downstream convertability, the process for adjusting the papermaking process comprising the steps of:

a) providing a first parent roll comprising a first web material to a parent roll converting operation, the first parent roll being produced by the papermaking process;
b) measuring a first physical property of the first web material in the MD and CD during the converting of the first parent roll by the parent roll converting operation;
c) measuring a second physical property of the first web material in the MD and CD during the converting of the first parent roll by the parent roll converting operation;
d) placing the measured first and second physical properties of the first web material into a data table;
e) manipulating the measured first and second physical properties of the first web material in the MD from the data table over time;
f) manipulating the measured first and second physical properties of the first web material in the CD from the data table over time;
g) generating a relationship equation for each of the measured first and second physical properties of the first parent roll correlating each of the first and second physical properties of the first web material;
h) providing a second parent roll comprising a second web material to the parent roll converting operation, the second parent roll being produced by the papermaking process;
i) measuring the first physical property of the second web material in the MD and CD during the converting of the second parent roll by the parent roll converting operation;
j) measuring the second physical property of the second web material in the MD and CD during the converting of the second parent roll by the parent roll converting operation;
k) comparing each of the first physical property of the second web material and the second physical property of the second web material to the relationship equation generated in step (g);
l) generating a correction for the relationship equation generated in step (g) that correlates each of the first and second physical properties of the second web material;
m) using the corrected relationship equation generated in step (l) to create a control algorithm that minimizes variability of either of the first and second physical properties of a third web material, the third web material to be formed into a third parent roll;
n) adjusting the papermaking process for producing the third parent roll by applying the control algorithm generated in step (m) to a centerline related to the papermaking process;
o) producing the third web material according to the adjusted papermaking process; and,
p) winding the third web material produced by the papermaking process of step (o) into the third parent roll.

2. The process of claim 1 further comprising the step of selecting said parent roll converting operation of step (a) from the group consisting of calendaring, slitting, folding, web material conveying, embossing, laminating, printing, combining, and combinations thereof.

3. The process of claim 1 wherein said step (e) further comprises the steps of:

i) applying a filter to the measured data for the measured first and second physical properties of the first web material in the MD from the data table over time;
ii) detecting anomalous measured first and second physical properties of the first web material in the MD;
iii) discarding outlying measured first and second physical properties of the first web material in the MD; and,
iv) stratifying any remaining measured first and second physical properties of the first web material in the MD.

4. The process of claim 3 wherein said step (iv) further comprises the step of:

1) reviewing the measured first and second physical properties of the first web material in the MD in situ.

5. The process of claim 3 wherein said step (iv) further comprises the step of:

1) reviewing all measured first and second physical properties of the first web material in the MD for the first parent roll.

6. The process of claim 1 wherein said step (f) further comprises the steps of:

i) applying a filter to the measured data for the measured first and second physical properties of the first web material in the CD from the data table over time;

ii) detecting anomalous measured first and second physical properties of the first web material in the CD;

iii) discarding outlying measured first and second physical properties of the first web material in the CD; and, iv) stratifying any remaining measured first and second physical properties of the first web material in the CD.

7. The process of claim 6 wherein said step (iv) further comprises the step of:

1) reviewing the measured first and second physical properties of the first web material in the CD in situ.

8. The process of claim 1 wherein said step (g) further comprises the steps of:

1) comparing the averaged measured first and second physical properties of the first web material correlating each of the first and second physical properties of the web material to the web material stretch;

2) using an analysis tool to develop correlations between the averaged measured first and second physical properties of the first web material correlating each of the first and second physical properties of the web material to the web material stretch;

3) designing a test that detects correlations between measured variables and actual web properties using a statistical method;

4) determining which measured variables are most directly related to the web material stretch; and, 5) validating the correlation.

9. The method of claim 1 further comprising the step of selecting said first physical property of the first web material from the group consisting of web material basis weight, web material caliper, web material moisture content, web material surface topography, and/or web material fiber orientation, web material processing general stop data, web material processing general quality control data, the amount of web material broke, web material tensions and/or draws, log compressibility, roll diameter, winder stops, un-wind stand stops, and combinations thereof.

10. The method of claim 1 further comprising the step of selecting said second physical property of the first web material from the group consisting of web material basis weight, web material caliper, web material moisture content, web material surface topography, and/or web material fiber orientation, web material processing general stop data, web material processing general quality control data, the amount of web material broke, web material tensions and/or draws, log compressibility, roll diameter, winder stops, un-wind stand stops, and combinations thereof.

11. The process of claim 1 wherein said step (l) further comprises the steps of:

a) adjusting the relationship equation factors;

b) adding and/or subtracting the relationship equation factors from the current relationship equation; and, c) re-validating the relationship equation.

12. A process for adjusting a papermaking process for producing parent rolls of convolutely wound web material having a machine direction (MD) and a cross-machine direction (CD) coplanar and orthogonal thereto that improves the characteristics of the parent rolls of wound web material to improve downstream convertability, the process for adjusting the papermaking process comprising the steps of:

a) conveying a first web material produced by the papermaking process to a measurement station;

b) measuring a first property of the first web material in the MD and CD prior to forming a first parent roll;

c) measuring a second property of the first web material in the MD and CD prior to forming the first parent roll;

d) conveying the first web material to a winding process, the winding process convolutely winding the first web material to form the first parent roll;

e) placing the first and second measured properties of the first web material into a data table;

f) manipulating the measured data for each of the first and second properties of the first web material in the MD from the data table over time;

g) manipulating the measured data for each of the first and second properties of the first web material in the CD from the data table over time;

h) generating a relationship equation for each of the measured first and second properties of the first web material;

i) providing the first parent roll to a parent roll converting operation;

j) measuring the first physical property of the first web material in the MD and CD during the parent roll converting operation;

k) measuring the second physical property of the first web material in the MD and CD during the parent roll converting operation;

l) comparing each of the measured first and second physical properties of the first web material during the parent roll converting operation to the relationship equation generated in step (h);

m) generating a correction for the relationship equation generated in step (h) that correlates each of the measured first and second physical properties of the first web material during the parent roll converting operation;

n) using the corrected relationship equation generated in step (m) to create a control algorithm that minimizes variability of either of the first and second physical properties of the first web material;

o) adjusting the papermaking process by applying the control algorithm generated in step (n) to a centerline related to the papermaking process;

p) producing a second web material according to the adjusted papermaking process; and, q) winding the second web material produced by the papermaking process of step (p) into a second parent roll.

13. The process of claim 12 wherein said step (f) further comprises the steps of:

i) applying a filter to the measured data for the measured first and second physical properties of the first web material in the MD from the data table over time;

ii) detecting anomalous measured first and second physical properties of the first web material in the MD;

iii) discarding outlying measured first and second physical properties of the first web material in the MD; and, iv) stratifying any remaining measured first and second physical properties of the first web material in the MD.

14. The process of claim 13 wherein said step (iv) further comprises the step of:

1) reviewing all measured first and second physical properties of the first web material in the MD for the first parent roll.

15. The process of claim 12 wherein said step (g) further comprises the steps of:

i) applying a filter to the measured data for the measured first and second physical properties of the first web material in the CD from the data table over time;

ii) detecting anomalous measured first and second physical properties of the first web material in the CD;

iii) discarding outlying measured first and second physical properties of the first web material in the CD; and, iv) stratifying any remaining measured first and second physical properties of the first web material in the CD.

16. The process of claim 12 wherein said step (m) further comprises the steps of:

a) adjusting the relationship equation factors;

b) adding and/or subtracting the relationship equation factors from the current relationship equation; and, c) re-validating the relationship equation.

17. The process of claim 12 wherein said step (h) further comprises the steps of:

1) comparing the averaged measured first and second physical properties of the first web material correlating each of the first and second physical properties of the web material to the web material stretch;

2) using an analysis tool to develop correlations between the averaged measured first and second physical properties of the first web material correlating each of the first and second physical properties of the web material to the web material stretch;

3) designing a test that detects correlations between measured variables and actual web properties using a statistical method;

4) determining which measured variables are most directly related to the web material stretch; and, 5) validating the correlation.

18. The method of claim 12 further comprising the step of selecting said first physical property of the first web material from the group consisting of web material basis weight, web material caliper, web material moisture content, web material surface topography, and/or web material fiber orientation, web material processing general stop data, web material processing general quality control data, the amount of web material broke, web material tensions and/or draws, log compressibility, roll diameter, winder stops, un-wind stand stops, and combinations thereof.

19. The method of claim 12 further comprising the step of selecting said second physical property of the first web material from the group consisting of web material basis weight, web material caliper, web material moisture content, web material surface topography, and/or web material fiber orientation, web material processing general stop data, web material processing general quality control data, the amount of web material broke, web material tensions and/or draws, log compressibility, roll diameter, winder stops, un-wind stand stops, and combinations thereof.

* * * * *